US010031447B2

(12) United States Patent
Tsukijima

(10) Patent No.: US 10,031,447 B2
(45) Date of Patent: Jul. 24, 2018

(54) BELT CONVEYING DEVICE AND IMAGE FORMING APPARATUS HAVING STEERING CONTROL MECHANISM

(71) Applicant: CANON KABUSHIKI KAISHA, Tokyo (JP)

(72) Inventor: Hisashi Tsukijima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/247,363

(22) Filed: Aug. 25, 2016

(65) Prior Publication Data

US 2017/0060044 A1 Mar. 2, 2017

(30) Foreign Application Priority Data

Aug. 31, 2015 (JP) ..... 2015-171568

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
USPC ..... 399/302
See application file for complete search history.

(56) References Cited

U.S. PATENT DOCUMENTS

| | | | | |
|---|---|---|---|---|
| 7,668,491 | B2 * | 2/2010 | Furuya | G03G 15/1615 399/302 |
| 2009/0169274 | A1 * | 7/2009 | Suzuki | G03G 15/161 399/302 |
| 2012/0148299 | A1 * | 6/2012 | Yamamoto | G03G 15/1615 399/121 |
| 2013/0101323 | A1 * | 4/2013 | Nakagawa | G03G 15/0189 399/302 |
| 2013/0108334 | A1 * | 5/2013 | deJong | G03G 15/1615 399/312 |

FOREIGN PATENT DOCUMENTS

| | | | |
|---|---|---|---|
| JP | 9-208075 | A | 8/1997 |
| JP | 2000-305415 | A | 11/2000 |
| JP | 2002-2999 | A | 1/2002 |
| JP | 2010-223981 | A | 10/2010 |
| JP | 2011-133730 | A | 7/2011 |
| JP | 2013-003381 | A | 1/2013 |
| JP | 2014-134577 | A | 7/2014 |

* cited by examiner

*Primary Examiner* — Quana M Grainger
(74) *Attorney, Agent, or Firm* — Canon U.S.A., Inc. IP Division

(57) ABSTRACT

A belt conveying device is configured such that if belt deviation in which a belt moves in a direction separated from a predetermined position is detected by a belt position detection mechanism, a control unit controls a driving unit to make a steering roller to be tilted intermittently in a direction to correct the belt deviation and, if it is detected by the belt position detection mechanism that a moving direction of the belt has changed to a direction to approach the predetermined position in a suspension period between the intermittent tilting operation, suspends the subsequent tilting of the steering roller.

13 Claims, 18 Drawing Sheets

FIG. 11

| No. | STATUS | BELT POSITION | SENSOR OUTPUT (○:TRANSMIT, ●:LIGHT-SHIELD) | | | | |
|---|---|---|---|---|---|---|---|
| | | | 1 | 2 | 3 | 4 | 5 |
| 0 | ERROR | 4ΔL TO | ○ | ○ | ○ | ○ | ○ |
| 1 | REAR MAXIMUM | 3ΔL TO 4ΔL | ○ | ○ | ○ | ○ | ● |
| 2 | REAR LARGE | 2ΔL TO 3ΔL | ○ | ○ | ○ | ● | ● |
| 3 | REAR MEDIUM | ΔL TO 2ΔL | ○ | ○ | ● | ● | ● |
| 4 | REAR SMALL | 0 TO ΔL | ○ | ● | ● | ● | ● |
| 5 | FRONT SMALL | -ΔL TO 0 | ● | ● | ● | ● | ○ |
| 6 | FRONT MEDIUM | -2ΔL TO -ΔL | ● | ● | ● | ○ | ○ |
| 7 | FRONT LARGE | -3ΔL TO -2ΔL | ● | ● | ○ | ○ | ○ |
| 8 | FRONT MAXIMUM | -4ΔL TO -3ΔL | ● | ○ | ○ | ○ | ○ |
| 9 | ERROR | TO -4ΔL | ● | ○ | ○ | ○ | ○ |

BELT CONVEYING DEVICE AND IMAGE FORMING APPARATUS HAVING STEERING CONTROL MECHANISM

BACKGROUND

Field

Aspects of the present invention generally relate to a belt conveying device used in an image forming apparatus, such as a copier, a printer, and a facsimile machine of an electrophotographic system or an electrostatic recording system, and relates also to an image forming apparatus provided with the belt conveying device.

Description of the Related Art

In an image forming apparatus of an electrophotographic system or an electrostatic recording system, a belt conveying device provided with an endless belt (hereafter, also referred to as a "belt") trained around a plurality of tension rollers is used. The belt is used as a conveyance member which bears and conveys a toner image, and bears and conveys a recording material on which the toner image is formed. The conveyance member which bears and conveys the toner image may be, for example, a belt-shaped electrophotographic photoconductor (a photoconductor belt), and an intermediate transfer member (an intermediate transfer belt) which bears and conveys the toner image transferred from the photoconductor to be transferred to the recording material. The conveyance member which bears and conveys the recording material on which the toner image is formed may be, for example, a recording material bearing member (a conveying belt) which bears and conveys the recording material on which the toner image is transferred from the photoconductor.

A belt trained around a plurality of tension rollers and driven to rotate (i.e., conveyed) generally has a problem of "belt deviation (i.e., meandering)" which is a phenomenon that the belt deviates toward either one end portion in the width direction when driven to rotate. The belt deviation occurs because of diametral accuracy of each tension roller, alignment accuracy among the tension rollers, and other factors.

To avoid belt deviation, active steering control has been proposed (see Japanese Patent Laid-Open No. 2002-2999 and No. 2010-223981). In active steering control, deviation of the belt from a predetermined position in the width direction is detected and at least one tension roller (i.e., a steering roller) is tilted to other tension rollers, whereby the belt is moved in the direction opposite to that of the deviation.

Another image forming apparatus is capable of forming an image while switching a conveyance speed of a belt among a plurality of speeds depending on, for example, the type of a recording material used for the output of the image. Setting a tilting speed of a steering roller to be lower as the conveyance speed of the belt becomes smaller so that steering control does not become unstable even when the belt is conveyed at a plurality of conveyance speeds is proposed (see Japanese Patent Laid-Open No. 2000-305415).

If the steering roller is tilted in accordance with the deviation of the belt in the width direction, however, the belt is twisted and the conveyance condition (e.g., speed) of the belt changes transitionally. The influence of the change in the conveyance condition of the belt tends to become significant especially when the belt is used as, for example, an intermediate transfer belt to which toner images are transferred from a plurality of image bearing members in a tandem image forming apparatus. This is because the change in the conveyance condition of the belt on a surface to which the toner images are transferred from a plurality of image bearing members (i.e., an image transfer surface) causes misalignment in positions at which the toner images of a plurality of colors overlap one another, and causes "color misalignment" which may impair quality of an output image. If a moving speed of the belt in the width direction to correct the deviation of the belt position in the width direction is high, color misalignment may easily be caused especially in the width direction of the belt.

In order to reduce the change in the conveyance condition of the belt to reduce the influence on the image quality, it is desirable to perform a tilting operation of the steering roller sufficiently gently. If the conveyance speed of the belt is low, it is more desirable to perform the tilting operation of the steering roller relatively more gently.

However, as an operation of a mechanism system which causes the steering roller to be tilted becomes more quasi-static, an influence of friction becomes larger, and the tilting operation may become unstable due to backlash and stick slip of mechanical components. That is, there is a limit in making the tilting operation itself of the steering roller gentle (i.e., making the tilting speed itself lower).

SUMMARY

Aspects of the present invention provide a belt conveying device and an image forming apparatus capable of reducing a transitional change in a conveyance condition of a belt due to tilting of a steering roller and reducing an excessively high moving speed of the belt in a width direction.

According to an aspect of the present invention, a belt conveying device including: an endless belt; a tension roller around which the belt is supported and configured to convey the belt; a steering roller around which the belt is supported, at least one end side of the steering roller being supported to be swingable, and capable of changing a position of the belt in a width direction; a first detection unit configured to detect that the position of the belt in the width direction is in a first area located on the outer side than a predetermined position in the width direction of the belt; a second detection unit configured to detect that the position of the belt in the width direction is in a second area adjacent to the first area and located on the outer side than the first area in the width direction of the belt; a motor configured to steer the steering roller; and a control unit configured to control the motor based on a detection result of the first detection unit and the second detection unit, wherein, when it is detected that an end portion of the belt has moved to the second area from the first area, the control unit increases a steering amount of the steering roller intermittently to a predetermined upper limit while the end portion of the belt is located in the second area and, when the end portion of the belt returns to the first area from the second area before the steering amount of the steering roller reaches the predetermined upper limit, the control unit stops the increase in the steering amount of the steering roller without increasing the steering amount of the steering roller to the predetermined upper limit.

According to another aspect of the present invention, an image forming apparatus includes the belt conveying device of the present invention, and a toner image forming unit configured to form a toner image on the belt or on a recording material born by the belt.

Further features of aspects of the present invention will become apparent from the following description of exemplary embodiments with reference to the attached drawings.

BRIEF DESCRIPTION OF THE DRAWINGS

FIG. 11 is a diagram illustrating correspondence between combinations of output signals of the belt position detection mechanism and belt positions.

DESCRIPTION OF THE EMBODIMENTS

Hereafter, a belt conveying device and an image forming apparatus according to aspects of the present invention are described in more detail with reference to the drawings.

First Embodiment

1. Entire Configuration and Operation of Image Forming Apparatus

Figure 1:
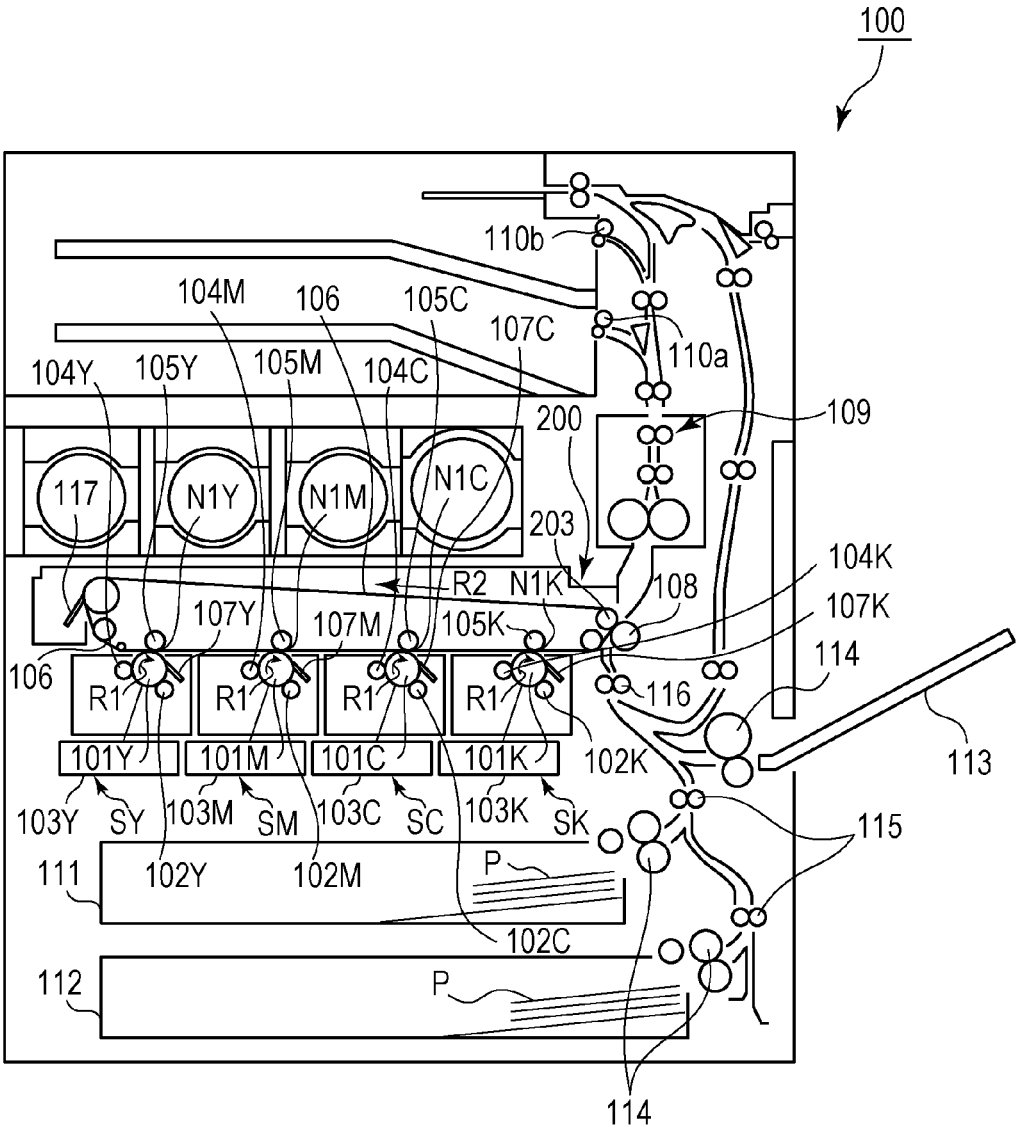
FIG. 1 is a schematic cross-sectional view of an image forming apparatus.

FIG. 1 is a schematic cross-sectional view of an image forming apparatus according to an embodiment of the present invention. An image forming apparatus 100 of the present embodiment is a tandem color digital printer of an intermediate transfer system capable of forming a color image using an electrophotographic system.

The image forming apparatus 100 includes a plurality of image forming units (i.e., stations): first, second, third and fourth image forming units SY, SM, SC and SK for forming images of yellow (Y), magenta (M), cyan (C) and black (K), respectively. In the present embodiment, the image forming units SY, SM, SC and SK are substantially the same in basic configuration and operation except for the color of toner used in a developing process. Therefore, unless distinction is required, the image forming units SY, SM, SC and SK will be described collectively as an image forming unit S without attaching Y, M, C and K which represent the colors for which the units are provided.

The image forming unit S includes a photoconductive drum 101 which is a drum-shaped electrophotographic photoconductor (a photoconductor) as an image bearing member. The photoconductive drum 101 is driven to rotate in the direction of R1 in FIG. 1. In the image forming unit S, the following components are disposed around the photoconductive drum 1. A charging roller 102 which is a roller-shaped charging member as a charging unit is disposed. A laser scanner 103 as an exposure unit is disposed. A developing unit 104 as a developing unit is disposed. A primary transfer roller 105 which is a roller-shaped primarily transfer member as a primary transfer unit is disposed. A drum cleaner 107 as a photoconductor cleaning unit is disposed.

A surface of the rotating photoconductive drum 101 is charged substantially uniformly by the charging roller 102 to a predetermined potential of predetermined polarity (in the present embodiment, negative). The surface of the charged photoconductive drum 101 is exposed by the laser scanner 103 in accordance with an image signal so that an electrostatic latent image (an electrostatic image) in accordance with the image signal is formed on the photoconductive drum 101. An image signal corresponding to each image forming unit S is input in the laser scanner 103. The laser scanner 103 illuminates the surface of the photoconductive drum 101 with laser light in accordance with the image signal, neutralizes the charge on the photoconductive drum 101, and forms an electrostatic latent image. The electrostatic latent image formed on the photoconductive drum 101 is developed by the developing unit 104 with toner as a developer. In the present embodiment, toner which is charged to the same polarity of the charging polarity of the photoconductive drum 101 (in the present embodiment, negative) adheres to the exposed portion on the photoconductive drum 101 of which absolute value of potential has been lowered by being charged uniformly and then exposed (a reversal development).

The image forming apparatus 100 includes an intermediate transfer belt 106 constituted by an endless belt as an intermediate transfer member disposed to face each photoconductive drum 101 of each image forming unit S. The intermediate transfer belt 106 is driven to rotate in the direction of R2 in FIG. 1. The primary transfer roller 105 is disposed to face each photoconductive drum 101 of each image forming unit S on an inner peripheral surface side of the intermediate transfer belt 106. The primary transfer roller 105 is urged (pressed) toward the photoconductive drum 101 via the intermediate transfer belt 106, and forms a primary transfer portion (a primary transfer nip) N1 at which the intermediate transfer belt 106 and the photoconductive drum 101 are in contact with each other. On an outer peripheral surface side of the intermediate transfer belt 106, a secondary transfer roller 108 which is a roller-shaped secondary transfer member as a secondary transfer unit is disposed to face a secondary transfer facing roller 203 which is one of a plurality of tension rollers around which the intermediate transfer belt 106 is trained. The secondary transfer roller 108 is urged (pressed) toward the secondary transfer opposing roller 203 via the intermediate transfer belt 106, and forms a secondary transfer portion (a secondary transfer nip) N2 at which the intermediate transfer belt 106 and the secondary transfer roller 108 are in contact with each other. The primary transfer roller 105, the intermediate transfer belt 106, and a plurality of tension rollers around which the intermediate transfer belt 106 is trained constitute an intermediate transfer unit 200 as the belt conveying device in the present embodiment. The intermediate transfer unit 200 is described in more detail later.

The toner image formed on the photoconductive drum 101 is electrostatically transferred to the rotating intermediate transfer belt 106 in a primary transfer portion N1 by the effect of the primary transfer roller 105 (primary transfer). Primary transfer bias of polarity opposite to the charging polarity (regular charging polarity) of the toner during development is applied to the primary transfer roller 105. For example, at the time of forming a later-described full color image, a toner image of each color formed on each photoconductive drum 101 of each image forming unit S is transferred in each primary transfer portion N1 to the intermediate transfer belt 106 sequentially in an overlapping manner. The overlapped toner images for a full color image are formed on the intermediate transfer belt 106. Toner remaining on the photoconductive drum 101 after a primary transfer process (primary-transfer-residual toner) is removed from the photoconductive drum 101 by the drum cleaner 107 and is collected.

A recording material (a transfer material, a recording medium, or a sheet) P, such as paper, sent out of either of a cassette 111, a cassette 112, or a manual feed tray 113, is sent to a registration roller 116 by a feed roller 114, a conveyance roller 115, and the like. After a leading end of the recording material P abuts the stationary registration roller 116 and forms a loop, the registration roller 116 starts rotation in synchronization with the formation of the toner image on the intermediate transfer belt 106, and recording material P is conveyed to a secondary transfer portion N2.

The toner image on the intermediate transfer belt 106 is electrostatically transferred to the recording material P in the secondary transfer portion N2 by the effect of the secondary transfer roller 108 (secondary transfer). Secondary transfer bias of polarity opposite to the regular charging polarity of the toner is applied to the secondary transfer roller 108. Toner remaining on the intermediate transfer belt 106 after a secondary transfer process (secondary-transfer-residual toner) is removed from the intermediate transfer belt 106 by a belt cleaner 117 as an intermediate transfer member cleaning unit, and is collected.

The recording material P to which the toner image is transferred is sent to a fixing unit 109 as a fixing device, where the toner image is fixed to the recording material P with heat and pressure. The recording material P is then discharged from either of the discharge unit 110*a* or the discharge unit 110*b* to the outside of the apparatus.

In the present embodiment, the image forming units SY, SM, SC and SK constitute a toner image forming unit which forms toner images on the intermediate transfer belt 106.

2. Intermediate Transfer Unit

Next, a schematic configuration of the intermediate transfer unit 200 as the belt conveying device in the present embodiment is described.

Here, a direction to cross substantially perpendicularly the traveling direction (i.e., the conveyance direction) of the intermediate transfer belt 106 (i.e., the width direction) is also referred to as a "thrust direction." The thrust direction is substantially parallel to the direction of rotational axes of the photoconductive drum 101 and the tension rollers 201 to 205. Regarding the image forming apparatus 100, the front side in FIG. 1 in the thrust direction is referred to as a "front side" and the rear side is referred to as a "rear side." Although the up-down direction in the image forming apparatus 100 relates to the vertical direction, the up-down direction here includes not only directly above and below but upper and lower directions from a horizontal direction with respect to a reference position or element. Relationships between positions or arrangement of the elements in the image forming apparatus 100 are those in a case where the image forming apparatus 100 is disposed at a posture for a usual operation.

Figure 2:
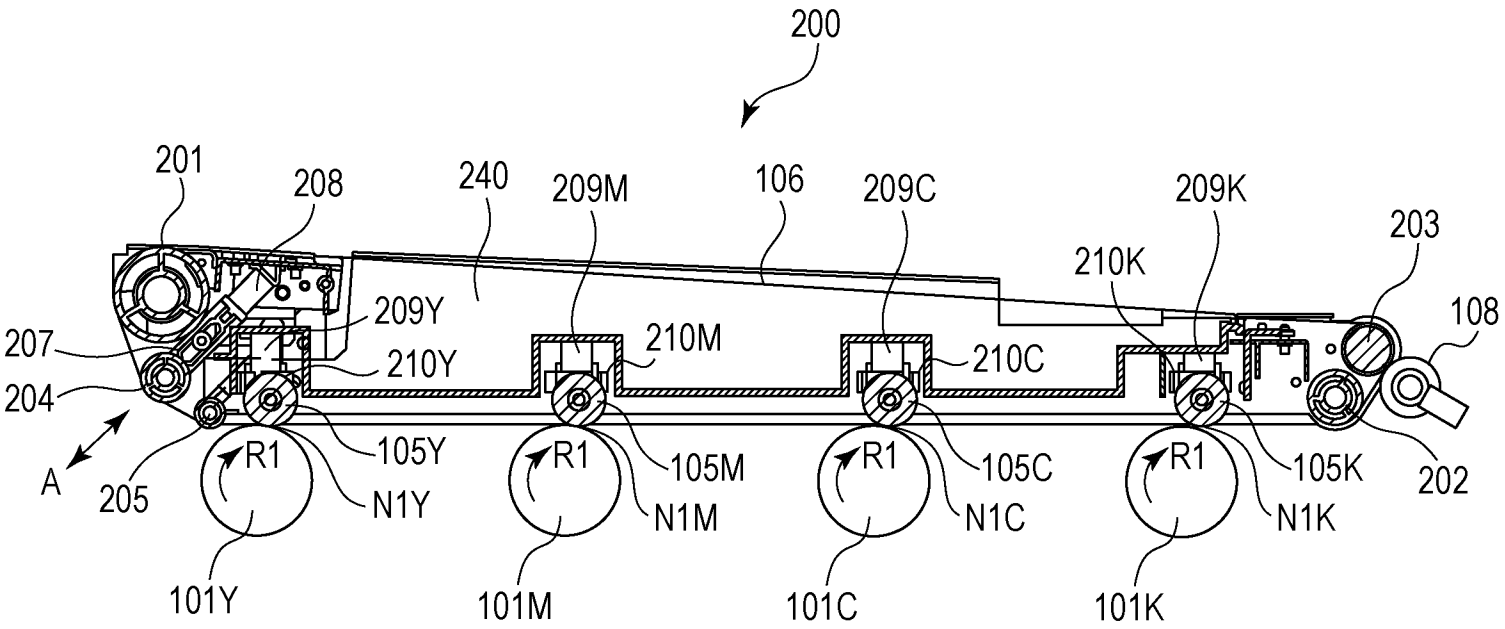
FIG. 2 is a schematic cross-sectional view of an intermediate transfer unit (in a color mode).

FIG. 2 is a schematic cross-sectional view of the intermediate transfer unit 200 (the photoconductive drum 101 and the secondary transfer roller 108 are also illustrated). The intermediate transfer unit 200 includes the intermediate transfer belt 106 as the intermediate transfer member. In the present embodiment, the intermediate transfer belt 106 is constituted by an endless belt (film) made from polyimide. The intermediate transfer belt 106, not being limited to polyimide, may be made from, for example, resin, such as polyvinylidene fluoride (PVDF), polyamide, polyethylene terephthalate (PET) and polycarbonate. The intermediate transfer belt 106 is trained around a plurality of tension rollers, i.e., five rollers of a driving roller 201, a tension roller 204, a backup roller 205, an idler roller 202, and a secondary transfer facing roller 203.

The four photoconductive drums 101 are arranged substantially linearly along a traveling direction of the intermediate transfer belt 106. In the present embodiment, the arranging direction of the four photoconductive drums 101 is substantially horizontal. In particular, in the present embodiment, the four photoconductive drums 101 are arranged substantially linearly so that a common tangent of all of these photoconductive drums 101 on the intermediate transfer unit 200 side becomes substantially horizontal.

The driving roller 201 is driven to rotate by a belt driving motor 270 (see FIG. 5) as a driving source, and rotates the intermediate transfer belt 106 in the direction of R2 in FIG. 1 (a circumference movement, conveyance). A surface of the driving roller 201 is formed from a rubber layer with a high friction coefficient to convey the intermediate transfer belt 106 without slip. A support configuration of the driving roller 201 is described in detail later.

The tension roller 204 is rotatably supported by the tension roller bearing member 207 at both end portions in the direction of the rotational axis. The tension roller bearing member 207 is attached to a later-described first frame 240 to be movable in the direction of arrow A in FIG. 2 (in the direction toward an outer peripheral surface side from an inner peripheral surface side of the intermediate transfer belt 106 and the opposite direction thereof). The tension roller bearing member 207 is urged toward the outer peripheral surface side from the inner peripheral surface side of the intermediate transfer belt 106 by a tension spring 208 which is an elastic member as an urging unit. The tension roller 204 is urged toward the outer peripheral surface side from the inner peripheral surface side of the intermediate transfer belt 106 and is pressurized against the inner peripheral surface of the intermediate transfer belt 106. Therefore, even if the length of the intermediate transfer belt 106 or dimensions of other parts vary by tolerance, the influence of the variation is absorbed when the position of the tension roller 204 is shifted in the direction of arrow A in FIG. 2, and the intermediate transfer belt 106 is kept with substantially constant tension.

The backup roller 205 forms an image transfer surface (a surface stretched in a substantially planar shape and to which the toner image is transferred from the photoconductive drum 101) with the idler roller 202. The backup roller 205 is rotatably supported by the first frame 240 via a bearing member (not illustrated) at both end portions in the direction of the rotational axis.

The idler roller 202 forms an image transfer surface with the backup roller 205 in a later-described color mode, and forms an image transfer surface with the tension roller 204 in a later-described monochrome mode. The idler roller 202 is rotatably supported by the first frame 240 via a bearing member (not illustrated) at both end portions in the direction of the rotational axis.

A secondary transfer opposing roller (a secondary transfer inner roller) 203 holds the intermediate transfer belt 106 with the secondary transfer roller (an external secondary transfer roller) 108 and forms the secondary transfer portion N2. The secondary transfer opposing roller 203 is rotatably supported by the first frame 240 via a bearing member (not illustrated) at both end portions in the direction of the rotational axis.

The intermediate transfer unit 200 includes primary transfer rollers 105Y, 105M, 105C and 105K. The primary transfer rollers 105Y, 105M, 105C and 105K are arranged to face the photoconductive drum 101Y, 101M, 101C and 101K, respectively, via the intermediate transfer belt 106. Each primary transfer roller 105 is disposed between the backup roller 205 and the idler roller 202 in the conveyance direction of the intermediate transfer belt 106. Each primary transfer roller 105 is rotatably supported at both end portions in the direction of the rotational axis by the primary transfer roller bearing member 210 which is attached movably to the first frame 240. The primary transfer roller bearing member 210 is guided by the first frame 240 to be movable unidirectionally (in the up-down direction in FIG. 2), and is urged toward the photoconductive drum 101 by a primary transfer spring 209 which is an elastic member as an urging unit. Each primary transfer roller 105 holds the intermediate transfer belt 106 with each corresponding photoconductive drum 101 and forms the primary transfer portion N1.

3. Separating and Contacting State of Photoconductive Drum and Intermediate Transfer Belt Next, a separating and contacting state between the photoconductive drum 1 and the intermediate transfer belt 106 is described.

Figure 3:
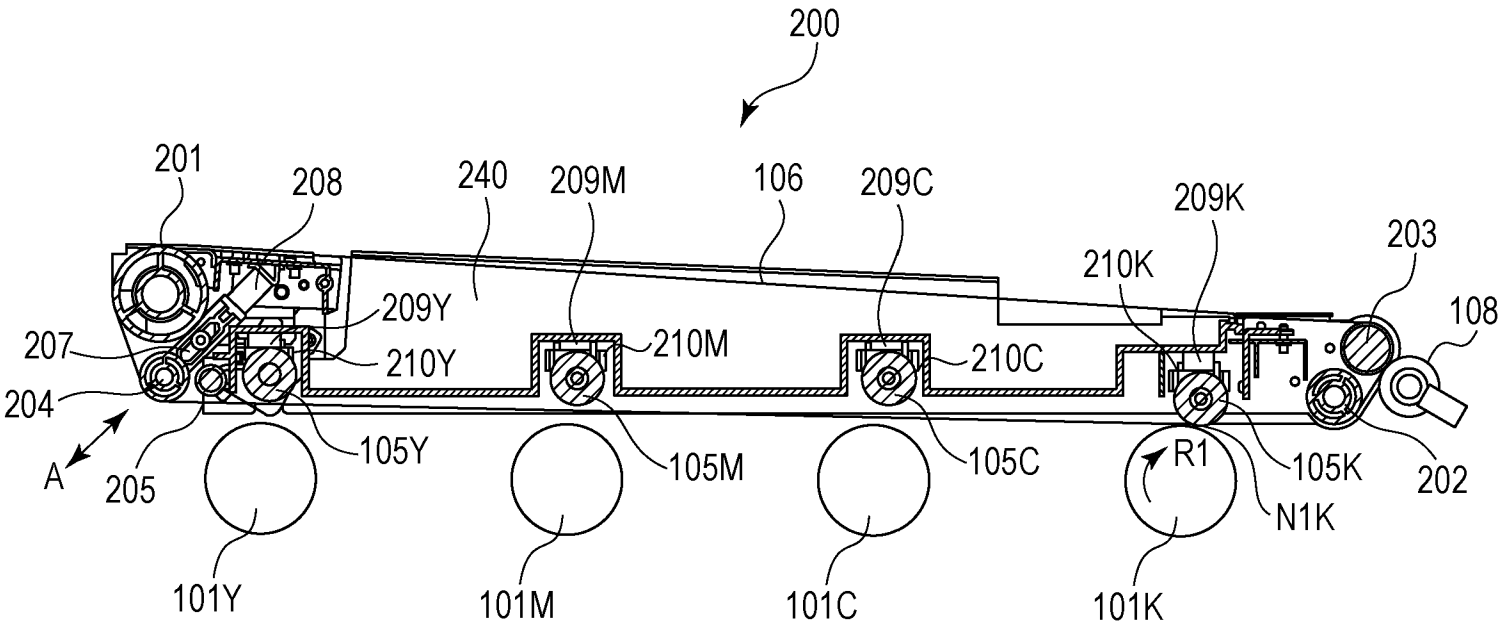
FIG. 3 is a schematic cross-sectional view of the intermediate transfer unit (in a monochrome mode).

The image forming apparatus 100 of the present embodiment is capable of forming an image while switching the image formation modes between the color mode and the monochrome mode (a single color mode). FIG. 2 illustrates a state in the color mode, and FIG. 3 is the same diagram as FIG. 2 but in the monochrome mode.

The color mode is an image formation mode in which images can be formed in all the image forming units SY, SM, SC and SK to form a full color image. The monochrome mode is an image formation mode in which an image is formed only in the image forming unit SK for black images to form a monochrome image. In the color mode, the intermediate transfer belt 106 is in contact with the photoconductive drum 101 in all the image forming units SY, SM, SC and SK. In the monochrome mode, the intermediate transfer belt 106 is separated from the photoconductive drum 101 in the image forming units SY, SM and SC for yellow, magenta and cyan which are not used for the image formation. This is, for example, to reduce wearing of the photoconductive drums 101 for yellow, magenta and cyan, and the intermediate transfer belt 106 to prolong the life of these components.

Figure 4:
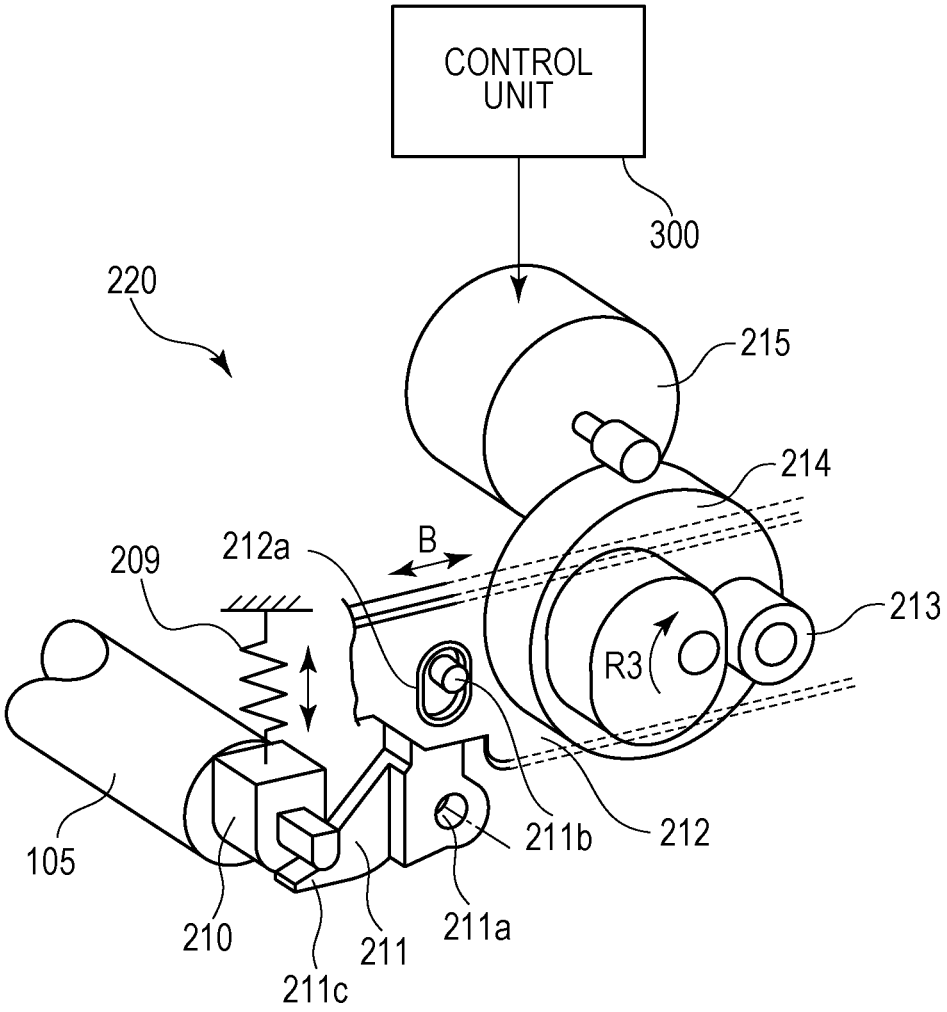
FIG. 4 is a perspective view of a separating and contacting mechanism.

In the present embodiment, the separating and contacting state between the photoconductive drum 101 and the intermediate transfer belt 106 in the color mode and in the monochrome mode is switched by the movement of the primary transfer rollers 105Y, 105M and 105C for yellow, magenta and cyan and the backup roller 205. The primary transfer rollers 105Y, 105M and 105C for yellow, magenta and cyan and the backup roller 205 are moved by a separating and contacting mechanism. FIG. 4 is a perspective view illustrating a separating and contacting mechanism 220. FIG. 4 illustrates a state in the color mode. FIG. 4 illustrates a portion near representative one of the primary transfer rollers 105. The separating and contacting mechanism 220 is provided in the intermediate transfer unit 200. The separating and contacting mechanism 220 is controlled by a control unit 300 provided in an apparatus main body of the image forming apparatus 100.

In the present embodiment, the separating and contacting mechanism 220 has substantially the same (i.e., line symmetry about the center of the intermediate transfer belt 106 in the thrust direction) components at both end portions in the thrust direction. In the following description, for the ease of description, the separating and contacting mechanism 220 is described focusing on the components on one end portion (the front side) in the thrust direction. In the present embodiment, the components at the end portion on the other side (i.e., the rear side) in the thrust direction operates in synchronization. The primary transfer rollers 105Y, 105M and 105C for cyan, yellow and magenta may be referred to as the primary transfer roller 105 collectively for a color image, and the photoconductive drums 101Y, 101M and 101C may be referred to as the photoconductive drum 101 collectively for a color image without attaching the Y, M and C.

4. Separating and Contacting Mechanism

Next, a configuration of the separating and contacting mechanism 220 is described. As illustrated in FIG. 4, the separating and contacting mechanism 220 includes a slider link 212 as a moving member which moves linearly. The slider link 212 is supported by the first frame 240 to be reciprocatable substantially parallel with the direction in which the photoconductive drums 101 are arranged as illustrated by an arrow B in FIG. 4. The separating and contacting mechanism 220 includes a cam (an eccentric cam) 214 which transmits driving force of a separating and contacting motor 215 as a driving unit to the slider link 212. The cam 214 is rotatably supported by the first frame 240 and engages with a roller 213 provided in the slider link 212. The separating and contacting mechanism 220 includes a separating and contacting arm 211 connected to the slider link 212. The separating and contacting arm 211 pivots about an axis which crosses substantially perpendicularly a moving direction of the slider link 212 so as to move the primary transfer roller bearing member 210 of the primary transfer roller 105 for color images. The separating and contacting arm 211 is pivotally supported by the frame 240 through a pivotal shaft hole 211*a*. A projection 211*b* of the separating and contacting arm 211 provided in an end portion engages with an separating and contacting arm engaging portion (an engaging hole) 212*a* of the slider link 212, and an acting portion 211*c* of the separating and contacting arm 211 provided in the other end portion engages with the primary transfer roller bearing member 210. Although FIG. 4 illustrates a portion near representative one of the primary transfer rollers 105, the separating and contacting mechanism 220 includes the separating and contacting arms 211 for the movement of each of the primary transfer rollers 105Y, 105M, and 105C for color images.

Each of the separating and contacting arms 211 is connected with the slider link 212 as described above.

Next, an operation of the separating and contacting mechanism 220 is described. In the image forming apparatus 100 of the present embodiment, the control unit 300 may store more frequently-used mode between the color mode and the monochrome mode as a default image formation mode. First, a case where the monochrome mode is set as the default image formation mode is described.

In the standby state of the image forming apparatus 100, the intermediate transfer unit 200 is in the state illustrated in FIG. 3. In particular, the primary transfer rollers 105 and the backup roller 205 for color images are retracted upward and separated from the inner peripheral surface of the intermediate transfer belt 106. The intermediate transfer belt 106 is separated from the photoconductive drums 101 for color images. The primary transfer roller 105K for black images abuts the photoconductive drum 101K for black images via the intermediate transfer belt 106 and forms a primary transfer portion N1K.

When a job in the monochrome mode is started, the following operation is performed. A job in the monochrome mode is started when monochrome copy is selected in an operation unit of the image forming apparatus 100 or a job in monochrome printing is sent to the image forming apparatus 100 from an external apparatus, such as a personal computer connected with the image forming apparatus 100. The driving roller 201 of the intermediate transfer unit 200 begins rotation counterclockwise in FIG. 3 from the state illustrated in FIG. 3, and the intermediate transfer belt 106 begins rotation in the direction of R2 in FIG. 1 (i.e., counterclockwise). At this time, the photoconductive drum 101 for color images remains stopped and only the photoconductive drum 101K for black images begins rotation in the direction of R1 in FIG. 3 (i.e., clockwise) at the same time as the start of the rotation of the intermediate transfer belt 106.

When a job in the color mode is started, the following operation is performed. A job in the color mode is started when color copy is selected in an operation unit of the image forming apparatus 100 or a job in color printing is sent to the image forming apparatus 100 from an external apparatus, such as a personal computer connected with the image forming apparatus 100. The control unit 300 makes the separating and contacting mechanism 220 operate by the separating and contacting motor 215 to change the state from that illustrated in FIG. 3 to that illustrated in FIG. 2.

As illustrated in FIG. 4, the primary transfer roller bearing member 210 is urged downward by the primary transfer spring 209, i.e., toward the photoconductive drum 101. In the state in the monochrome mode, the primary transfer roller bearing member 210 which supports the primary transfer roller 105 for color images is lifted by the separating and contacting arm 211 against the urging force of the primary transfer spring 209. Therefore, in the state in the monochrome mode, the primary transfer roller 105 for color images is separated from the inner peripheral surface of the intermediate transfer belt 106. The separating and contacting cam 214 supports the slider link 212 via the roller 213 against the urging force of the primary transfer spring 209. When the mode is switched from the monochrome mode to the color mode, the control unit 300 rotates the separating and contacting cam 214 in the direction of R3 in FIG. 4 by rotating the separating and contacting motor 215. Then, the slider link 212 moves translationally to the left in the direction of arrow B in FIG. 4 while keeping contact with the separating and contacting cam 214 and the roller 213. At this time, the acting portion 211*c* is pressed downward by the urging force of the primary transfer spring 209 via the primary transfer roller bearing member 210, and the slider link 212 presses the projection 211*b* by the separating and contacting arm engaging portion 212*a* so as to rotate the separating and contacting arm 211 counterclockwise in FIG. 4.

As in the separating and contacting arm 211, a backup roller bearing member which pivots about an axis crossing substantially perpendicularly the moving direction of the separating and contacting link is made to pivot by the separating and contacting link. Therefore, the backup roller 205 is moved toward the outer peripheral surface side from the inner peripheral surface side of the intermediate transfer belt 106.

The primary transfer roller 105 and the backup roller 205 for color images are moved cooperatively by the separating and contacting mechanism 220. In the color mode, the primary transfer rollers 105 for color images abut the corresponding photoconductive drums 101 for color images via the intermediate transfer belt 106, and form the primary transfer portions N1. In the color mode, when the backup roller 205 moves downward, the image transfer surface is formed with the idler roller 202. Therefore, tilting of the intermediate transfer belt 106 in a primary transfer portion N1Y for yellow color is reduced, and it is possible to form the primary transfer portion N1Y in the same manner as for other colors. In this manner, after the state illustrated in FIG. 2 is obtained, four photoconductive drums 101 and the intermediate transfer belt 106 begin rotation in the direction of R1 (i.e., clockwise) substantially simultaneously. After the job ends, the state returns to the state illustrated in FIG. 3 in the process opposite to that described above.

When the color mode is set as the default image formation mode, the following operation is performed. In the standby state of the image forming apparatus 100, the intermediate transfer unit 200 is in the state illustrated in FIG. 2, and when a job in the color mode is selected, rotation of the intermediate transfer belt 106 is started. When a job in the monochrome mode is selected, rotation of the intermediate transfer belt 106 is started after the state illustrated in FIG. 2 is changed to the state illustrated in FIG. 3, and the state returns to the state illustrated in FIG. 2 after the job ends.

5. Configuration of Steering Mechanism

Next, a steering mechanism which corrects deviation of the position of the intermediate transfer belt 106 in the width direction (hereafter, also referred to as a "belt position") caused by the belt deviation and returns the belt position to the substantial center is described.

Figure 5:
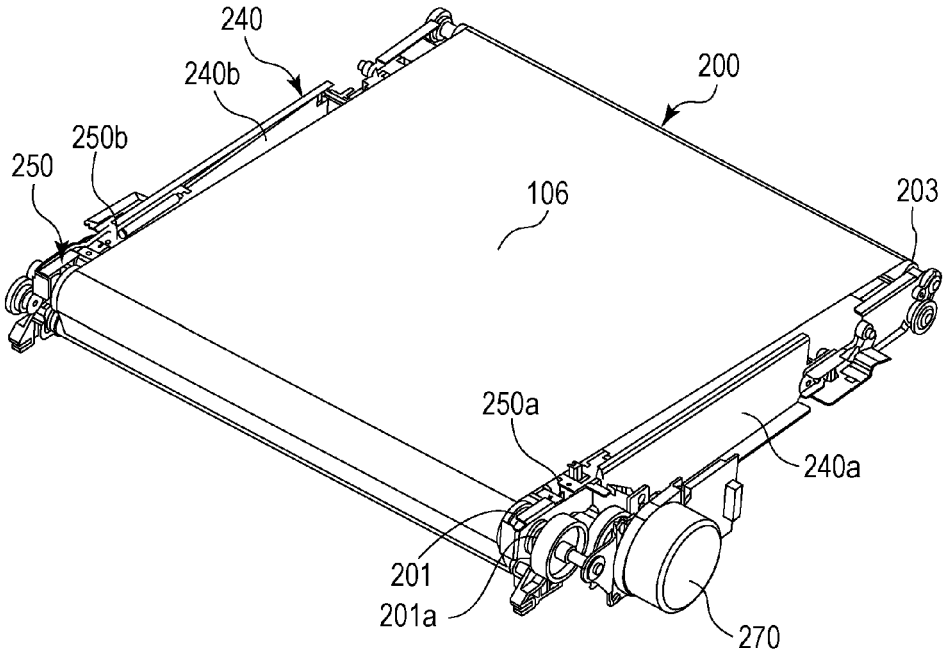
FIG. 5 is a perspective view of an intermediate transfer unit.
Figure 6:
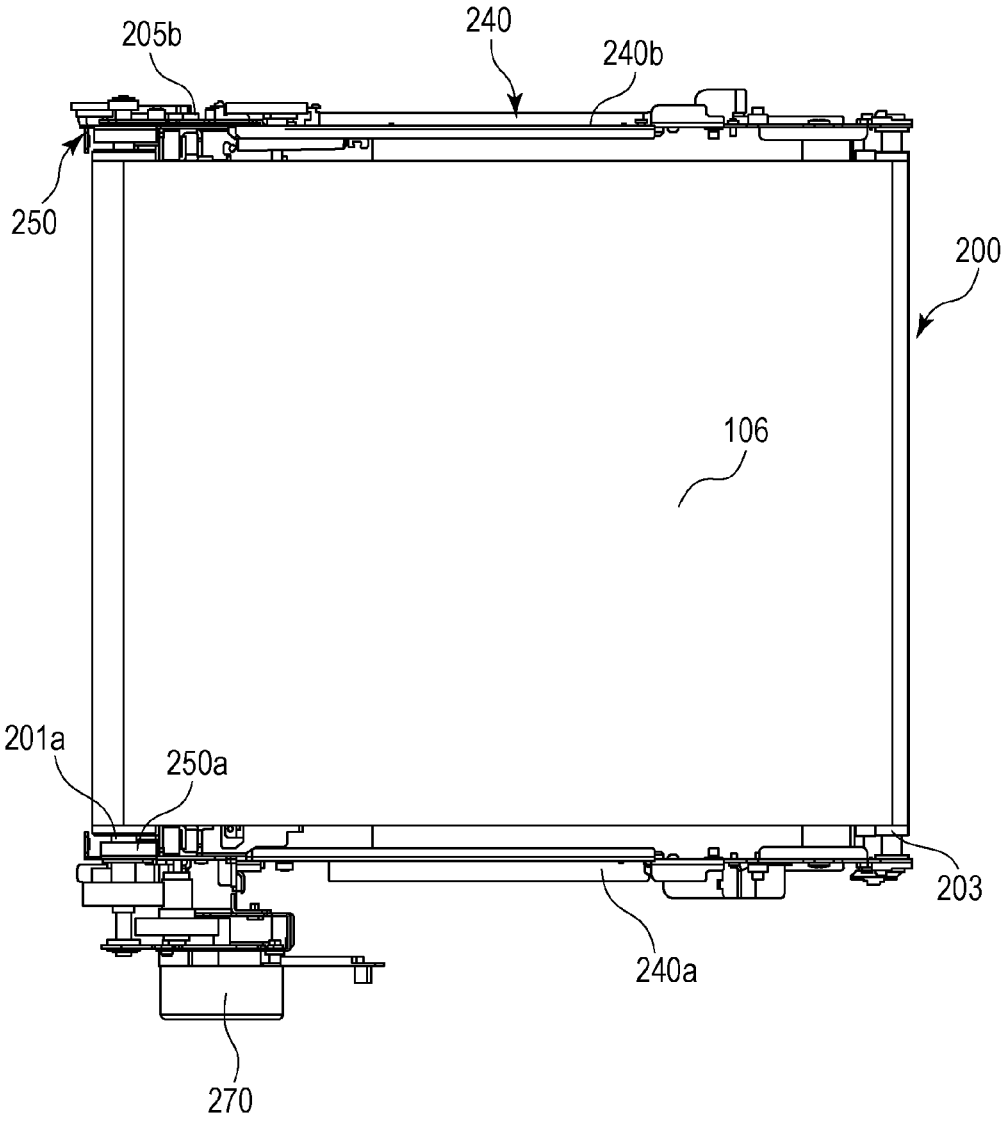
FIG. 6 is a top view of the intermediate transfer unit.
Figure 7:
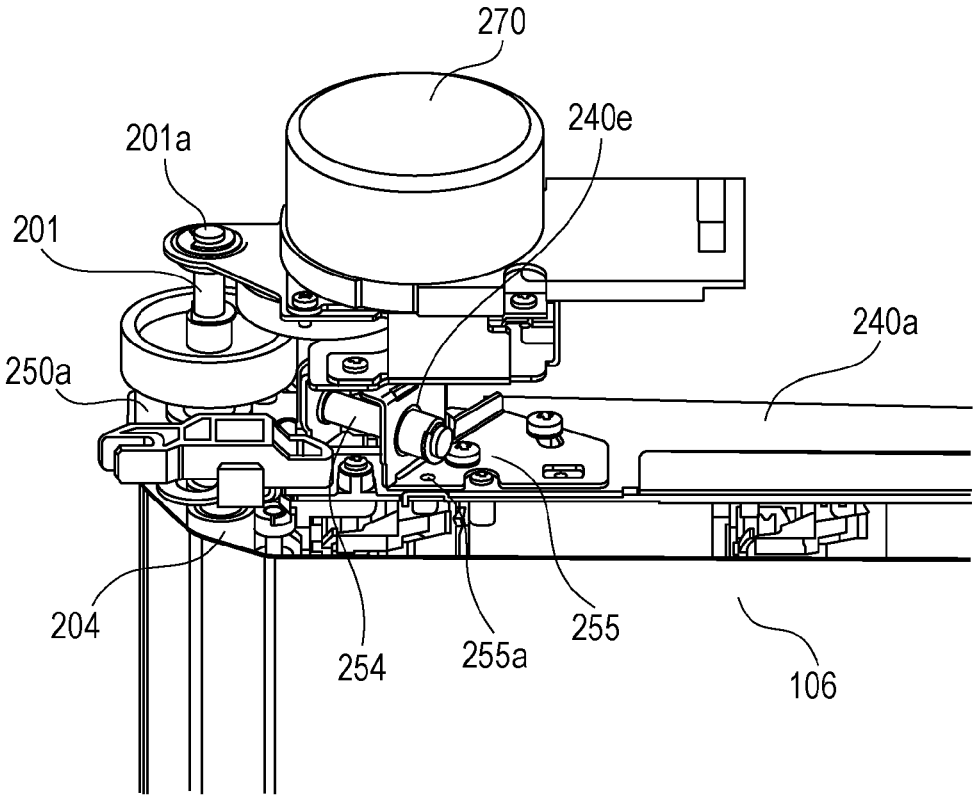
FIG. 7 is a fragmentary perspective view of a steering mechanism.
Figure 8:
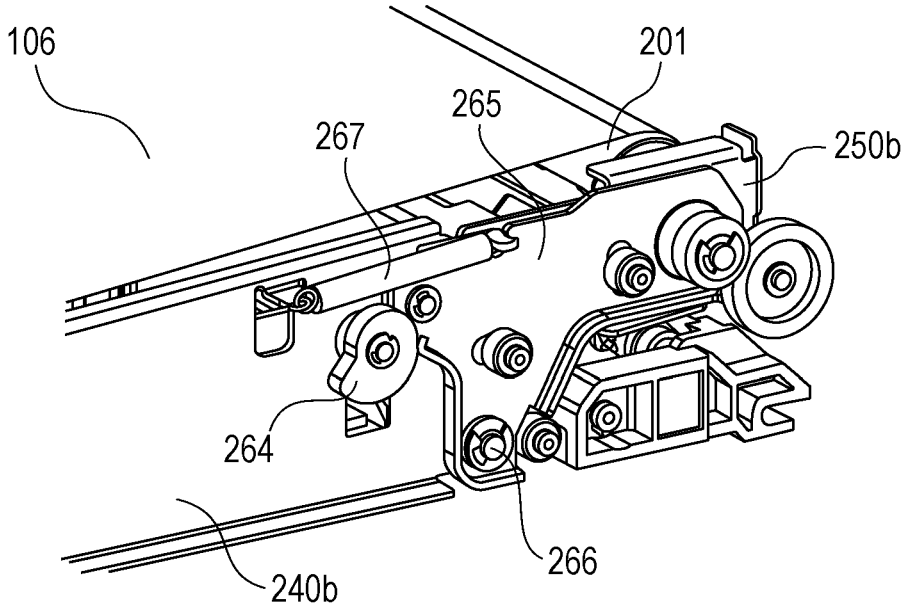
FIG. 8 is a fragmentary perspective view of the steering mechanism.
Figure 9:
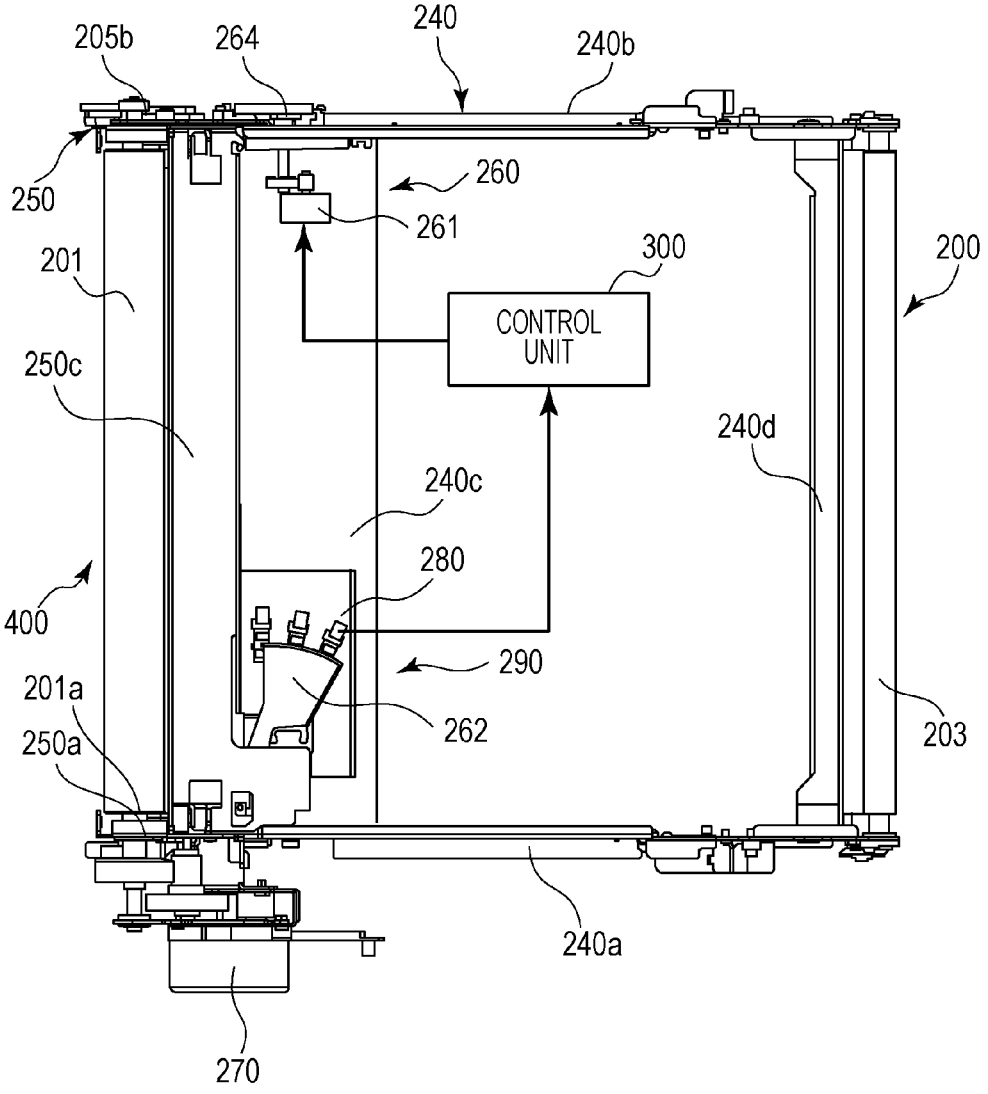
FIG. 9 is a plan view of the steering mechanism.
Figure 10:
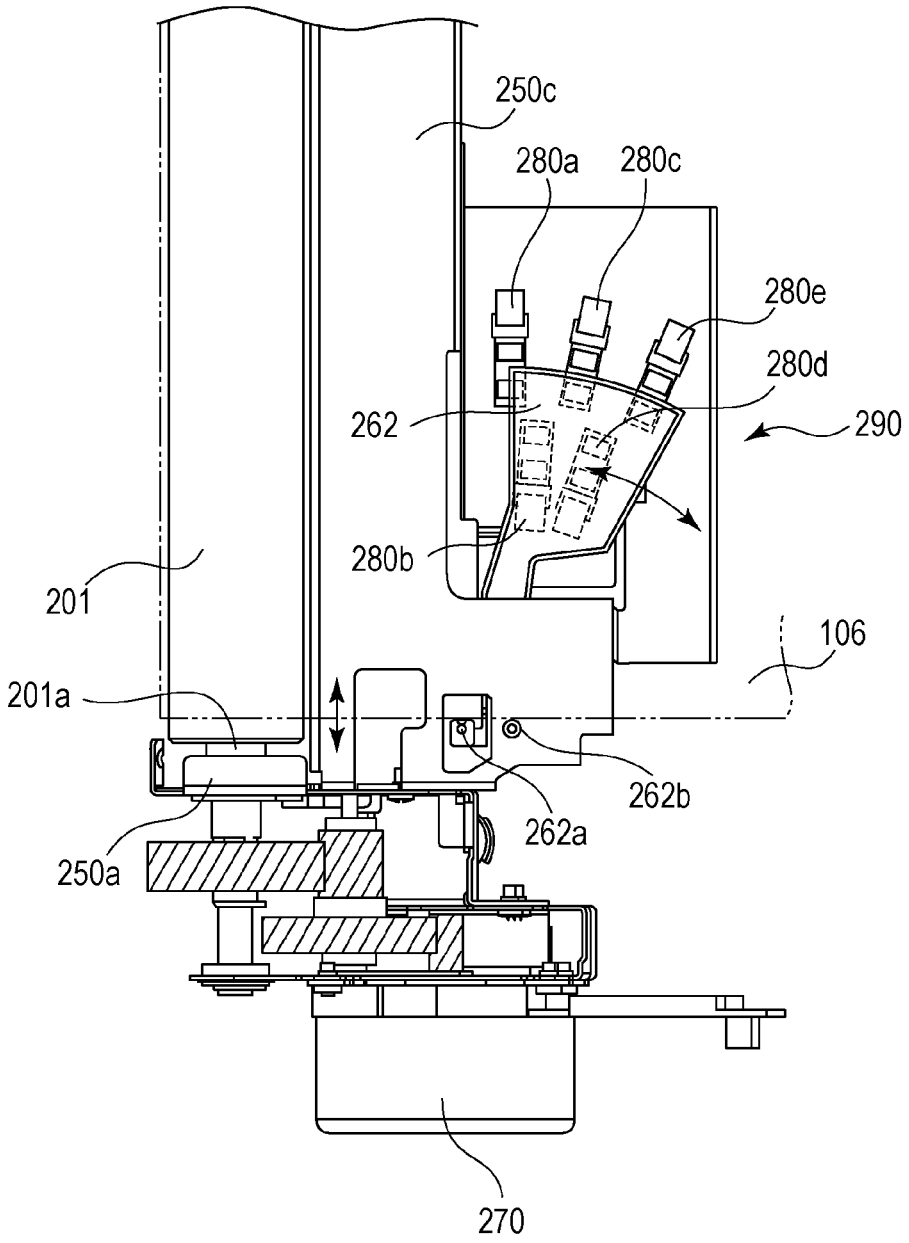
FIG. 10 is a plan view of a belt position detection mechanism.

FIG. 5 is a perspective view of the intermediate transfer unit 200 seen from the upper front. FIG. 6 is a top view of the intermediate transfer unit 200. FIG. 7 is a perspective view of a portion near an end portion of the driving roller 201 on the front side seen from below. FIG. 8 is a perspective view of a portion near an end portion of the driving roller 201 on the rear side seen from above. FIG. 9 is a plan view of a steering mechanism 400. FIG. 10 is a plan view of a later-described belt position detection mechanism. In FIGS. 5 to 10, some of the tension rollers illustrated in FIGS. 1 and 2 are not illustrated. FIG. 9 illustrates a state where the intermediate transfer belt 106 is removed from the intermediate transfer unit 200.

In the present embodiment, the driving roller 201 which drives the intermediate transfer belt 106 to rotate functions also as the steering roller which is tilted to other tension rollers in order to correct the belt position among a plurality of tension rollers around which the intermediate transfer belt 106 is trained. However, aspects of the present invention are not limited to the configuration in which the steering roller functions also as the driving roller. Alternatively, for example, in the same tension configuration as that illustrated in FIG. 2, the steering roller and the driving roller may function as different tension rollers while the idler roller 202 or the secondary transfer opposing roller 203 may be used as the driving roller.

The tension rollers 202 to 205 and the primary transfer roller 105 except the driving roller (hereafter, referred to as the "steering roller") 201 among a plurality of rollers around which the intermediate transfer belt 106 is trained are rotatably supported by the first frame 240 at both end portions in the direction of the rotational axis. In the first frame 240, as illustrated in FIG. 9, the side plate 240*a* on the front side and the side plate 240*b* on the rear side in the thrust direction are connected by two beam plates 240*c* and 240*d*.

An end portion of the rotational shaft 201*a* of the steering roller 201 on the front side among a plurality of tension rollers around which the intermediate transfer belt 106 is trained (a first end portion) is rotatably supported by a second frame 250 which is different from the first frame 240. An end portion of the rotational shaft 201*a* of the steering roller 201 on the rear side, i.e., on the opposite side of the first end portion (a second end portion) is rotatably supported by a later-described steering arm 265 (see FIG. 8). In the second frame 250, as illustrated in FIG. 9, the side plate 250*a* on the front side and the side plate 250*b* on the rear side in the thrust direction are connected by a beam plate 250*c*. As illustrated in FIG. 7, a tilting shaft 254 as a first rotating shaft provided in the side plate 250*a* of the second frame 250 on the front side is rotatably (pivotably) supported by a support portion (a support hole) 240*e* provided in the first frame 240. An end portion of the second frame 250 on the rear side in the thrust direction rotatably holds an end portion of the rotational shaft 201*a* of the steering roller 201 on the rear side, and is supported by the later-described steering arm 265 (see FIG. 8) via the steering roller 201. With this configuration, the second frame 250 can be tilted to the first frame 240.

The belt driving motor 270 is fixed to the second frame 250 on the front side in the thrust direction (on the same end portion side as the side on which the tilting shaft 254 which becomes the tilting center of the second frame 250 is provided). Driving force of the belt driving motor 270 is transmitted to the steering roller 201 via a gear train on the second frame 250.

As illustrated in FIG. 8, the steering arm 265 is rotatably (pivotably) supported by the first frame 240 about an arm rotating shaft 266 as a second rotating shaft provided on a side surface of the side plate 240*b* of the first frame 240 on the rear side. The steering arm 265 rotatably supports an end portion of the rotational shaft 201*a* of the steering roller 201 on the rear side separately from the second frame 250. Therefore, the steering arm 265 pivots on the side surface of the first frame 240 about the arm rotating shaft 266, and pivots on the side surface of the second frame 250 about the rotational shaft 201*a* of the steering roller 201. An eccentric cam 264 is provided on the side surface of the side plate 240*b* of the first frame 240 on the rear side. The steering arm 265 is urged by a steering spring 267 as an urging unit in the direction to pivot counterclockwise in FIG. 8 about the arm rotating shaft 266 so as to abut the eccentric cam 264. In the present embodiment, the steering spring 267 is constituted by an extension spring which is an elastic member, and is attached with both end portions in the stretching direction being hooked at each engaging portion provided in the side plate 240*b* of the first frame 240 on the rear side and in the steering arm 265. As illustrated in FIG. 9, the eccentric cam 264 is driven to rotate by a steering motor 261 as a driving source, and an angular position of the steering arm 265 in the pivoting direction is determined depending on the position at which the eccentric cam 264 stops. In the present embodiment, the steering motor 261 is a stepping motor. The steering motor 261 is attached to the beam plate 240*c* of the first frame 240. Therefore, the position of the end portion of the rotational shaft 201*a* of the steering roller 201 on the rear side can be shifted along a predetermined moving track by changing the position at which the eccentric cam 264 stops. In the present embodiment, a steering driving unit 260 includes the steering motor 261 and the eccentric cam 264.

As illustrated in FIG. 10, a belt position detection mechanism 290 as a detection unit for detecting the belt position is provided in the intermediate transfer unit 200. In the present embodiment, the belt position detection mechanism 290 includes a belt edge sensor flag (hereafter, also referred to as a "flag") 262, and a plurality of (five in the present embodiment) transmissive photo-interrupters 280*a* to 280*e*. The flag 262 is attached to the beam plate 250*c* of the second frame 250. The flag 262 is supported rotatably (pivotably) about a flag rotating shaft 262*b*. A rotatable detection roller 262*a* is provided in one end portion of the flag 262, and a light shielding portion (not illustrated) which shields the photo-interrupters 280*a* to 280*e* depending on the angular position in the pivoting direction of the flag 262 is provided in the other end portion of the flag 262. The flag 262 is urged so that the detection roller 262*a* pivots in the direction to abut a front end surface (i.e., a front edge) of the intermediate transfer belt 106, and pivots accompanying the generation of the belt deviation. The combination of output signals of the photo-interrupters 280*a* to 280*e* change depending on the belt position as the flag 262 shields the photo-interrupters 280*a* to 280*e* depending on the belt position. FIG. 11 illustrates a relationship between the combination of output signals of the photo-interrupters 280*a* to 280*e* and corresponding ten stages of belt positions from No. 0 to No.9.

Although the belt position is detected in ten stages by the five photo-interrupters 280*a* to 280*e* in the present embodiment, this configuration is not restrictive. Alternatively, for example, the number of the photo-interrupters may be increased to detect the belt position in a greater number of stages or vice versa. In the present embodiment, as illustrated in FIG. 11, the photo-interrupters 280*a* to 280*e* are disposed to be shielded by the flag 262 in this order, and the area widths of the stages are at substantially regular intervals ($\Delta L$). However, this configuration is not restrictive and the relationship between the combination of the output signals of the photo-interrupters and the belt positions depends on the shape of the flag or the arrangement of the photo-interrupters. For example, regarding the relationship between the combination of the output signals of the photo-interrupters and the belt positions, various definitions are possible, such as a case in which the intervals of the stages are adjusted intentionally to change the area widths partially or a case in which some of the areas detected at regular intervals are integrated to be considered as a single area. It is only necessary that the belt position detection mechanism 290 is capable of detecting the belt position. For example, the belt position detection mechanism 290 may detect the flag position using a linear image sensor, a distance measurement sensor, a gap sensor, and the like.

Although described later in detail, as illustrated in FIG. 9, the control unit 300 operates the steering motor 261 depending on the output signals of the photo-interrupters 280*a* to 280*e*. The driving force of the steering motor 261 drives the eccentric cam 264 to rotate and causes the steering arm 265 to pivot, whereby the steering roller 201 is tilted. Therefore, as the intermediate transfer belt 106 travels around, the position in the width direction of the intermediate transfer belt 106 is corrected.

In the present embodiment, the steering mechanism 400 is constituted by the second frame 250, the tilting shaft 254, the support portion 240*e*, the steering arm 265, the steering driving unit 260, the belt position detection mechanism 290, the control unit 300, and the like.

6. Operation of Steering Mechanism

Figure 12:
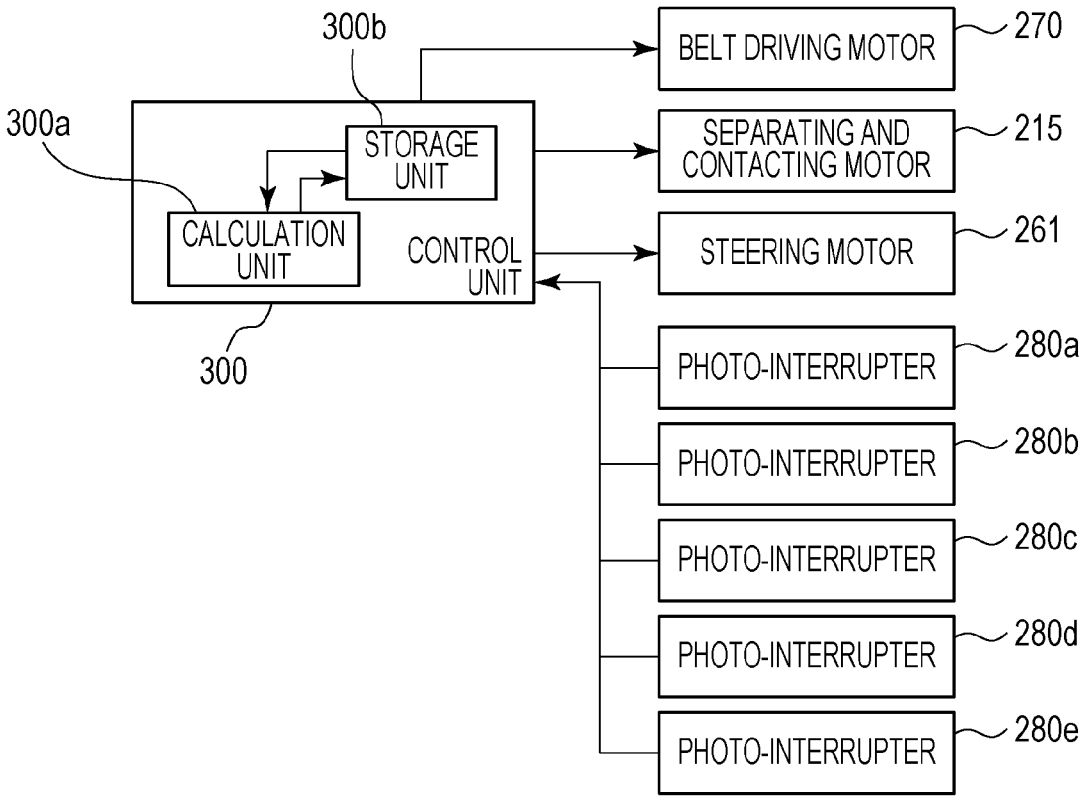
FIG. 12 is a schematic control block diagram about steering control.
Figure 13:
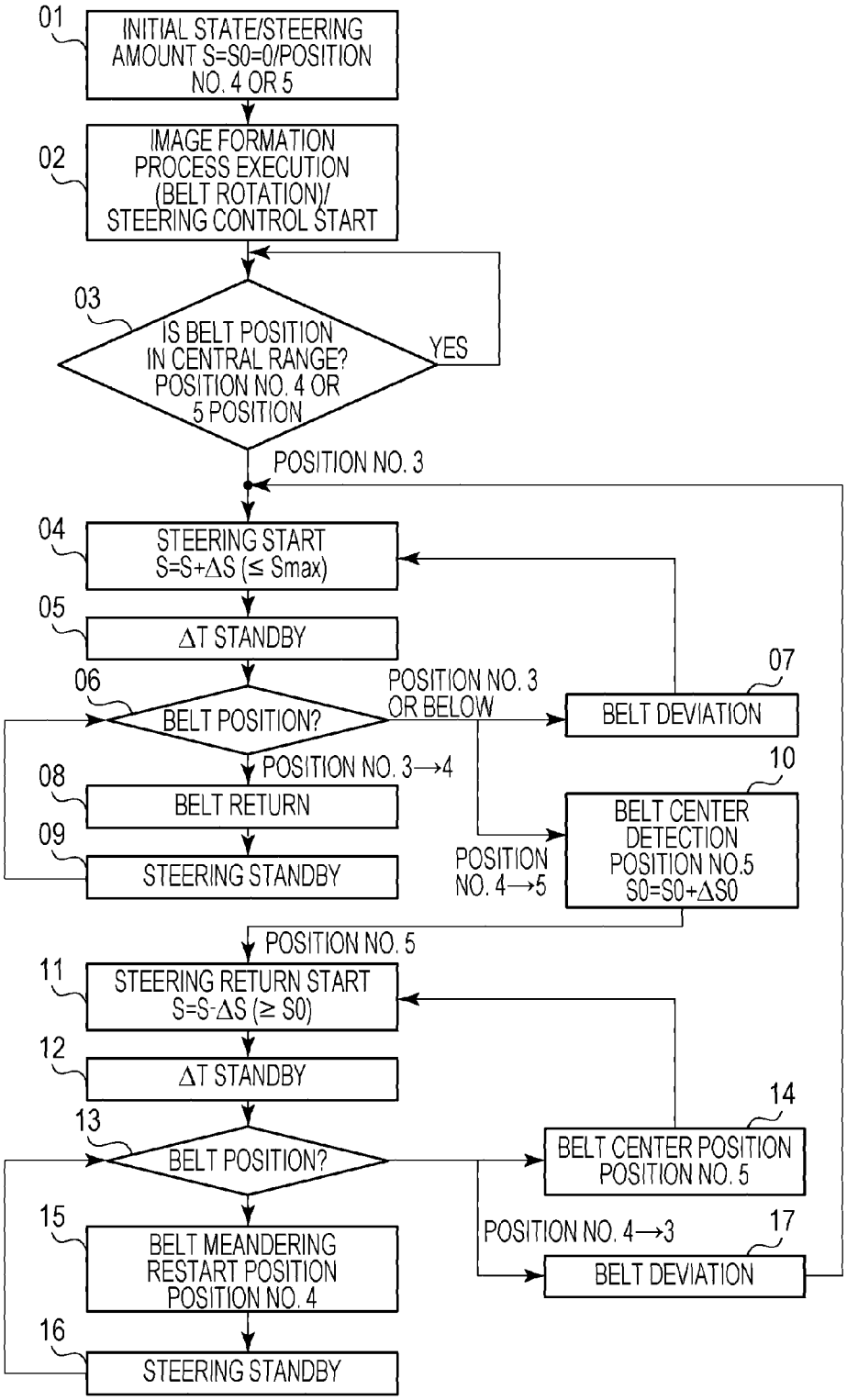
FIG. 13 is a flowchart of the steering control.
Figure 14:
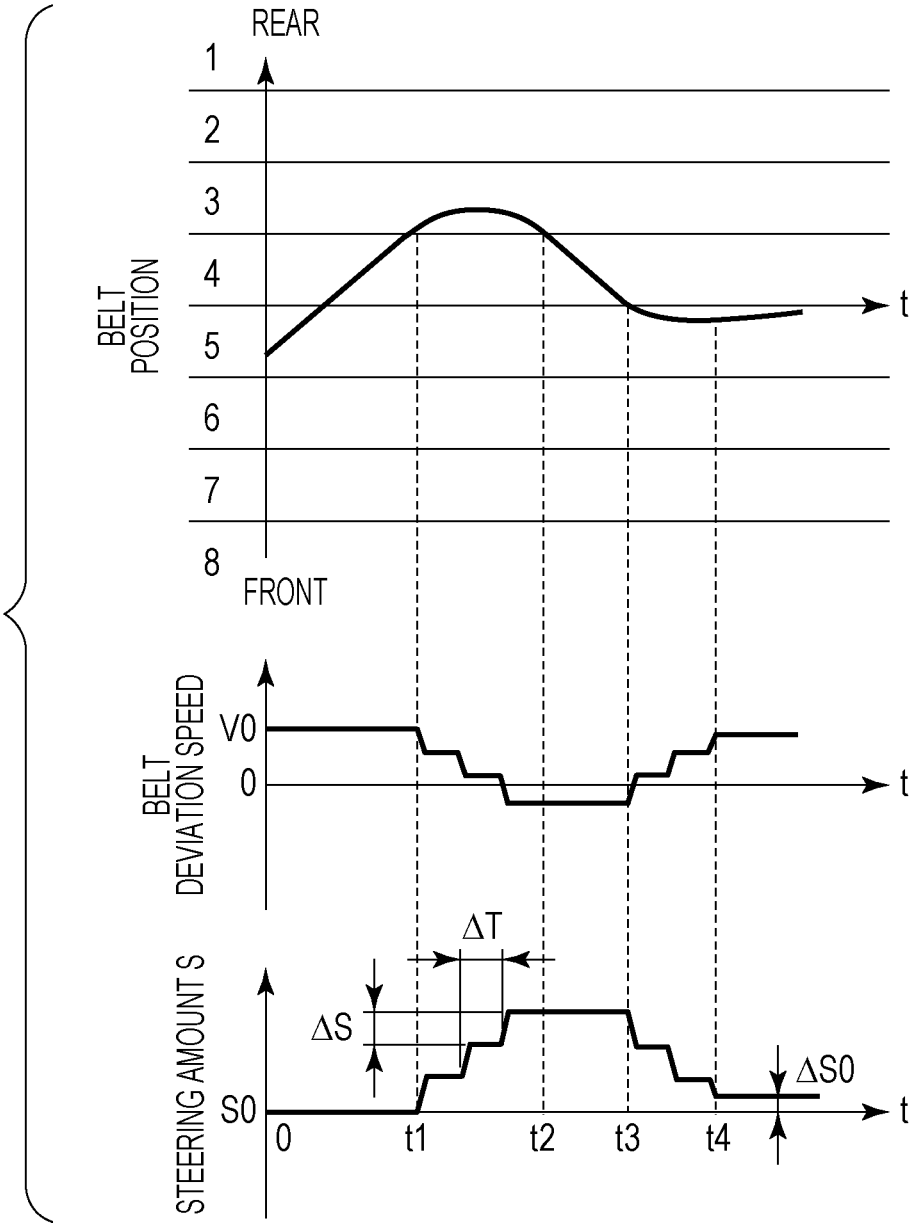
FIG. 14 is a graph chart illustrating transitions of a belt position, a belt deviation speed, and a steering amount during the steering control.

Next, a flow of the steering control by the steering mechanism 400 is described with reference to FIGS. 12 to 14. FIG. 12 is a schematic block diagram of the steering control and FIG. 13 is a schematic flowchart of the steering control. FIG. 14 is a graph chart illustrating transitions of the belt position, the belt deviation speed (the unidirectional moving speed of the intermediate transfer belt 106 in the width direction), and the steering amount (described below) by the steering control in the present embodiment.

The belt driving motor 270, the separating and contacting motor 215, the steering motor 261, the photo-interrupters 280*a* to 280*e* of the belt position detection mechanism 290, and the like are connected to the control unit 300. The control unit 300 includes a calculation unit 300*a* and a storage unit 300*b* for the process and storage of information about the steering control.

In the present embodiment, the tilting amount of the steering roller 201 (the tilting angle based on the state where the steering roller 201 is substantially parallel to other tension rollers) is managed by the rotation amount (the rotation angle) of the eccentric cam 264 and, more particularly, by the rotation amount (the rotation angle) of the steering motor 261. In the present embodiment, a change in the rotation amount (the rotation angle) of the eccentric cam 264 and a change in the tilting amount of the steering roller 201 (the tilting angle) are caused at a substantially constant rate. Therefore, in the present embodiment, when the eccentric cam 264 is rotated in a predetermined direction by a predetermined rotation amount (a rotation angle), the steering roller 201 is tilted by a predetermined tilting amount (a tilting angle) in a predetermined direction. Here, the rotation amount (the rotation angle) of the eccentric cam 264 corresponding to the tilting amount (the tilting angle) of the steering roller 201 is referred to as a "steering amount."

Tilting of the steering roller 201 (here, the rotation of the eccentric cam 264) in the direction in which unidirectional belt deviation is corrected is referred also to as a "steering operation." Tilting in the opposite direction to return the steering roller 201 tilted in the steering operation (here, the rotation of the eccentric cam 264) is referred also to as "steering return operation." As described later, the steering operation and the steering return operation are performed intermittently in the present embodiment. These intermittent tilting operations are referred also to as the "steering operation" and the "steering return operation."

A home position (steering amount S=S0=0) of the eccentric cam 264 is a position at which the posture of the steering roller 201 is substantially parallel to other tension rollers. When the belt position is No.4 or No.5 (more particularly, at a boundary between No.4 and No.5, the belt position is at the substantial center (step 01).

First, a case where the intermediate transfer belt 106 tends to move toward the rear side as the image formation (step 02) proceeds is considered. In this case, the belt position changes in the order of No.3, No.2 and No.1. When the belt position is No.4 or No.5, the eccentric cam 264 is still at the home position. When the belt position changes to No.3 (step 03), in order to return the belt position to the center, the control unit 300 rotates the eccentric cam 264 and makes the steering roller 201 be tilted (the steering operation). At this time, the control unit 300 rotates the eccentric cam 264 intermittently by a predetermined rotation amount (a steering amount) ΔS (step 04). The control unit 300 sets the time since the rotation of the eccentric cam 264 is started until the next rotation is started (a steering interval) to ΔT (step 05). The control unit 300 detects the belt position before rotating the eccentric cam 264 again after ΔT (step 06) and, if the belt position is still No.3 or if the belt position has further changed to No.2 (step 07), rotates the eccentric cam 264 again (step 04). Since there is a limit Smax in the steering amount, the control unit 300 does not add the steering amount exceeding the limit Smax.

If the belt position is shifted toward the rear side, the steering arm 265 pivots downward in FIG. 8 and the steering roller 201 is tilted so that an end portion on the rear side moves downward in FIG. 8. The pivotal direction of the eccentric cam 264 when the steering roller 201 is tilted in this direction is defined as a positive direction.

As illustrated in FIG. 14, the belt position is shifted toward the rear side gradually since the rotation of the intermediate transfer belt 106 is started (t=0) and, when the belt position becomes No.3 (t=t1), the steering amount increases by ΔS stepwise at the interval of ΔT, and the belt deviation speed (the direction toward the rear side is defined as a positive direction) is decreased gradually.

As the steering operation is repeated and the belt deviation speed becomes negative, the belt position begins to return to the center gradually. In FIG. 13, the control unit 300 detects the belt position at the interval of ΔT (step 06) and, if the belt position is shifted toward the central side, i.e., changes from No.3 to No.4, determines that the belt position begins to return to the center (step 08). In this case, the control unit 300 suspends (i.e., interrupts the intermittent steering operation to be performed at the interval of ΔT) without performing the next steering operation to be performed at the interval of ΔT (step 09). The control unit 300 detects the belt position at the interval of ΔT also during suspension of the steering operation (step 06).

As illustrated in FIG. 14, when it is determined that the belt position begins to return to the center (t=t2), the belt deviation speed and the steering amount thereafter change to a constant belt deviation speed and a constant steering amount, and the belt position returns toward the center gradually.

In FIG. 13, if the control unit 300 detects that the belt position has changed from No.4 to No.3 again during suspension of the steering operation (step 07), the control unit 300 resumes the steering operation (step 04). The control unit 300 performs the following operation when it detects that the belt position changed from No.4 to No. 5, i.e., the belt position as a predetermined position has exceeded the center (a boundary between No.4 and No.5), during suspension of the steering operation (step 10). The control unit 300 rotates the eccentric cam 264 in the opposite direction so that the steering roller 201 that has been tilted by the steering operation is tilted again to have a posture close to substantially parallel to other tension rollers (the steering return operation). In the same manner as the case of the steering operation described above, the control unit 300 sets the rotation of the eccentric cam 264 to an intermittent operation by a predetermined rotation amount (a steering amount) ΔS (step 11). The control unit 300 sets the time since the rotation of the eccentric cam 264 is started until the next rotation is started (the steering interval) to ΔT (step 12). The control unit 300 detects the belt position before rotating the eccentric cam 264 again after ΔT (step 13). If the belt position is still No.5 or if the belt position has further changed to No.6 (step 14), the control unit 300 rotates the eccentric cam 264 again (step 11).

If it is detected that the belt position is at the center as illustrated in FIG. 14 (t=t3), the steering amount thereafter decreases by ΔS stepwise at the interval of ΔT, and the belt deviation speed approaches zero.

As the steering return operation is repeatedly continued, the state returns to the initial state eventually. Here, in the initial state, the belt position tends to be shifted toward the rear side. Therefore, if the steering amount is returned to the original state (here, S=S0=0), the belt position begins to move toward the rear side again, and meandering does not stop. In the present embodiment, the steering return operation is stopped before the initial state. In particular, the control unit 300 makes the storage unit 300*b* store the steering amount S0 when the belt position is No.4 or No.5 (step 01). That is, the control unit 300 stores the initial position of the steering roller 201 in the tilting direction before the belt deviation is detected. The control unit 300 then detects that the belt position is shifted toward the rear side (step 03), and then returns to the center again (step 06). Then, the control unit 300 updates S0 by a correction amount ΔS0 as a steering amount to keep the belt position at the substantial center (No.4 or No.5), and stores the updated steering amount in the storage unit 300*b* (step 10). That is, the control unit 300 updates the initial position to a position tilted in the direction to correct the belt deviation and stores the corrected position. The steering return operation is performed up to S0 after the update (step 11).

As the belt deviation and the correction of the belt position toward the center are repeated by the steering operation to update S0 by ΔS0, a steering amount in which the belt position is balanced without deviated in neither directions in the width direction of the intermediate transfer belt 106 (this amount is referred to as a "true balance point Sn") is exceeded. If the true balance point Sn is exceeded by updating S0, that is, when S0<Sn<S0+ΔS0 (ΔS0>0) or S0>Sn>S0+ΔS0 (ΔS0<0), the tendency of the belt deviation at the time of returning the steering amount to S0 after update changes. Then, when the belt position returns to the substantial center again by the steering operation, S0 is updated again and returns to a value before the previous update. Therefore, since the steering amount when the belt position is at the substantial center (No.4 or No. 5) is converged to two values (S0 and S0+ΔS0) and deviation remains to the true balance point Sn, meandering of the intermediate transfer belt 106 does not converge although it is gentle. It is usually difficult to know the true balance point Sn. However, the deviation can be reduced by the control unit 300 controlling to reduce ΔS when, for example, it determines that the steering amount converges to the two values after the steering operation is repeated. For example, the control unit 300 may control to gradually reduce the steering amount by a predetermined amount ΔS whenever it determines that the steering amount has converged to the two values as described above. However, even if ΔS=0 eventually and S0 does not change, the true balance point Sn can change with a change in the state accompanying operation/stop of the apparatus and switching of other operations, a temporal change, and the like. Therefore, when the control unit 300 determines that a tendency of the unidirectional belt deviation has appeared again, the control unit 300 can, for example, increase ΔS which has been reduced gradually as described above (e.g., return to the initial value).

There is a case where power supply of the apparatus is turned off in a state in which the control unit 300 determines that the belt position begins to return to the center and suspends the next steering operation (step 09). In this case, in order to continue the steering operation from the suspended state when resuming the steering control, a change in the state of the apparatus during suspension, i.e., a change in the tendency of the belt deviation, may become indefinite. Therefore, the following operation is desirably performed when resuming the steering control. The belt position is detected in accordance with the flowchart of FIG. 13 and, if it is detected that the belt position has moved toward one side, an intermittent steering operation to return the belt position (step 04) is desirably performed.

Figure 15:
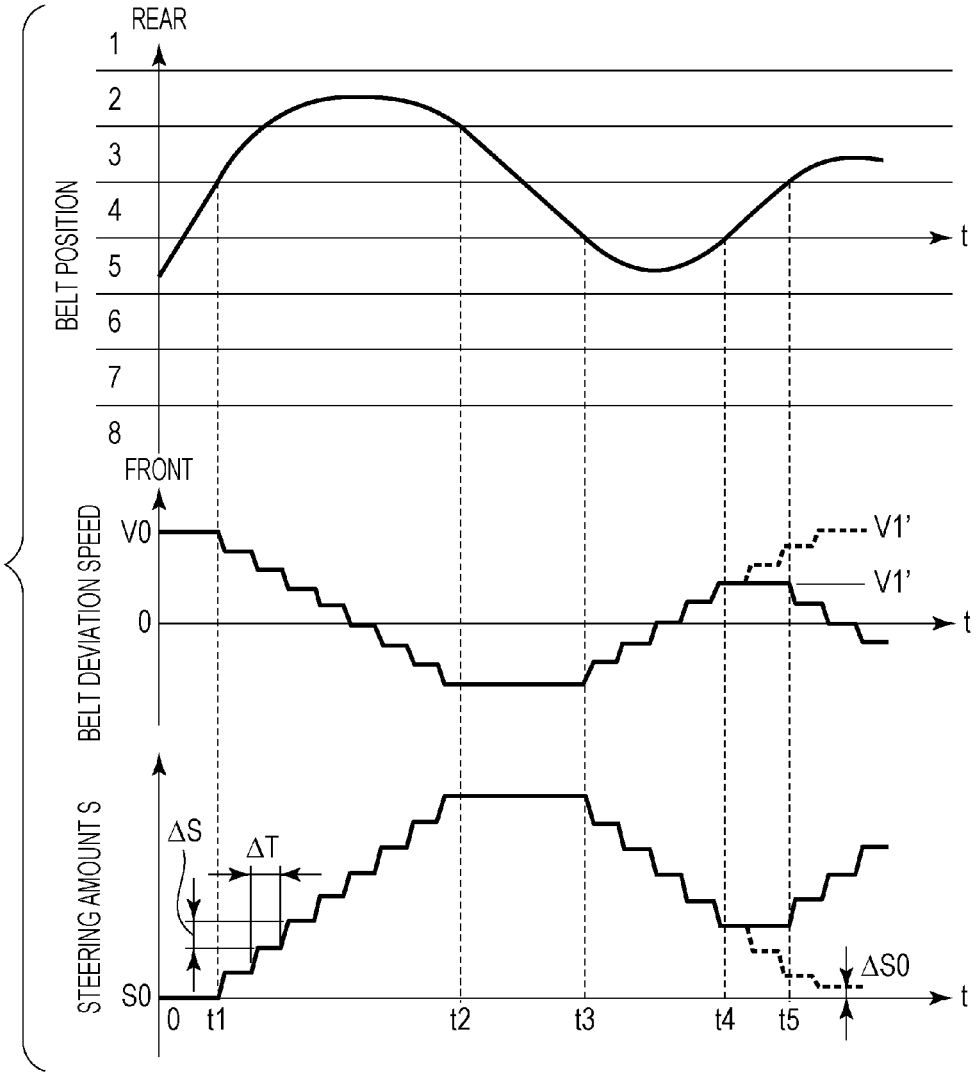
FIG. 15 is a graph chart illustrating transitions of a belt position, a belt deviation speed, and a steering amount during the steering control (when initial belt deviation speed is high).

FIG. 15 is a graph chart illustrating transitions of the belt position, the belt deviation speed, and the steering amount when the initial belt deviation speed V0 is higher than the case illustrated in FIG. 14. Also in the case illustrated in FIG. 15, the belt position is shifted toward the rear side since the rotation of the intermediate transfer belt 106 is started and, when the belt position becomes No. 3, the steering amount increases stepwise by ΔS at the interval of ΔT. In the case illustrated in FIG. 15, the belt position changes from No. 3 to No. 2 before the belt deviation speed becomes zero. By adding the steering amount at the interval of ΔT in accordance with the flowchart of FIG. 13 (steps 04 to 07), the belt deviation speed changes to negative and the belt position returns from No. 2 to No. 3. In the case illustrated in FIG. 14, since the belt position when the belt position is shifted to the maximum to the rear side is No. 3, it is determined that the belt position begins to return to the center by detecting that the belt position has changed from No. 3 to No. 4. In the case illustrated in FIG. 15, the belt position when the belt position is shifted to the maximum to the rear side is No. 2. Therefore, the control unit 300 determines that the belt position begins to return to the center by detecting that the belt position changes from No. 2 to No. 3 (step 08), and suspends the next steering operation (step 09). With this configuration, excessive acceleration in the moving speed of the intermediate transfer belt 106 in the width direction at the time of returning the belt position to the center (the belt return speed) can be avoided, and the amount of the later-described steering return operation can be made small. The control unit 300 thus changes the timing at which it determines that the belt position begins to return to the center depending on the maximum shift of the belt position to the rear side. Therefore, the control unit 300 updates the maximum shift (the belt position number) whenever the belt position is shifted to the rear side (i.e., the belt position number changes) until the belt position returns to the center, and stores the updated maximum shift in the storage unit 300*b*.

As in the case illustrated in FIG. 15, the control unit 300 performs the steering return operation as in the case illustrated in FIG. 14 if it detects that the belt position returns toward the center and has exceeded the center (i.e., the boundary between No. 4 and No. 5) (step 10). However, if the initial speed of the belt deviation is high as in the case illustrated in FIG. 15, the belt position begins to be shifted toward the rear side again (re-meandering) before the steering amount reaches S0, and the belt position changes from No. 5 to No. 4 (step 15). If the steering return operation is repeatedly continued thereafter, the belt deviation toward the rear side is promoted. Therefore, if it is detected that the belt position has changed from No. 5 to No. 4, the control unit 300 determines that the belt deviation has resumed and suspends the steering return operation (step 16). The control unit 300 detects the belt position at the interval of ΔT also during suspension of the steering return operation (step 13). The control unit 300 resumes the steering return operation (step 11) if the belt position changes from No. 4 to No. 5 again (step 14).

If the belt position further continues approaching the rear side and changes from No. 4 to No. 3 after the suspension of the steering return operation, the control unit 300 determines that belt deviation has occurred (step 17), and controls to perform steering operation to correct the belt deviation (step 04). Alternatively, as described above, the control unit 300 may suspend (i.e., interrupt) the steering return operation and then switch to the steering operation. Therefore, a belt deviation speed V1 when the belt position is shifted toward the rear side again is significantly lower than the speed (V1') of a case where the steering amount of the steering roller 201 is restored to S0 after update without suspending the steering return operation (FIG. 15).

Therefore, the belt deviation speed changes to negative and the belt position can be returned to the center again more promptly.

Generally, if an excessively high moving speed is produced in the width direction of the intermediate transfer belt 106, especially if an excessively high belt deviation speed (a belt return speed) on the image transfer surface is produced, the following phenomenon occurs. Misalignment of the transfer positions in the width direction of the intermediate transfer belt 106 when the toner images of a plurality of colors overlap one another on the intermediate transfer belt 106, i.e., "color misalignment" is caused, whereby quality of the output image may be reduced. In the steering control of the present embodiment, on the contrary, the behavior of the intermediate transfer belt is checked while repeating the intermittent steering operation (or the intermittent steering return operation) as described above. When it is detected that the belt position begins to return to the center (or begins to deviate again), a further steering operation (or a steering return operation) is suspended. Therefore, the belt return speed and the belt deviation speed during re-meandering can be lowered, and color misalignment in the width direction of the intermediate transfer belt 106 caused by the steering operation can be reduced by making the meandering of the intermediate transfer belt 106 converge gently and promptly.

The steering control has been described with a case where the belt position tends to be shifted toward the rear side. The steering control in the case where the belt position tends to be shifted toward the front side is the same as that of the case described above, but the tilting direction of the steering roller 201 is reverse in the steering operation and in the steering return operation. Repeated description is omitted. When the belt position is shifted toward the front side, the belt position changes in the order of No. 6, No. 7 and No. 8. When the belt position changes from No. 5 to No. 6, the control unit 300 rotates the eccentric cam 264 in the direction opposite to that in the case where the belt position is shifted toward the rear side as described above (step 04) and makes the steering roller 201 be tilted (the steering operation). The control unit 300 sets the rotation of the eccentric cam 264 to an intermittent operation by ΔS at the interval of ΔT. Then, when the belt position changes from No. 6 to No. 5, the control unit 300 determines that the belt position begins to return to the center, and suspends the steering operation. Then, if it is detected that the belt position has changed from No. 5 to No. 4, the control unit 300 rotates the eccentric cam 264 in the direction opposite to that of the steering operation, and makes the steering roller 201 be tilted in the direction opposite to that of the steering operation (the steering return operation). Also at this time, the control unit 300 sets the rotation of the eccentric cam 264 to an intermittent operation by ΔS at the interval of ΔT. The control unit 300 performs the steering return operation up to S0 after update. If the belt position changes as No. 5, No. 6 and No. 7 even after the steering operation is performed, the control unit 300 determines that the belt position begins to return to the center on the basis of the change of the belt position from No. 7 to No. 6, and suspends the steering operation. In this case, when the steering return operation is performed with the belt position exceeding the center (i.e., changing the belt position from No. 5 to No. 4), the belt position may change from No. 4 to No. 5 before reaching S0 after update. In this case, the control unit 300 determines that the belt position begins approaching the front side again, and makes the steering return operation suspended. If the belt position changes from No. 5 to No. 4 again, the control unit 300 resumes the steering return operation and, if the belt position changes from No. 5 with No. 6, the control unit 300 determines that the belt deviation has occur and makes the steering operation be performed.

In the present embodiment, the tilting amount (the tilting angle) of the steering roller 201 is managed by the rotation amount (the rotation angle) of the eccentric cam 264, more particularly, managed by the rotation amount (the rotation angle) of the steering motor 261, and the rotation amount (the rotation angle) of the eccentric cam 264 is referred to as the "steering amount." In the present embodiment, the steering amount is increased or decreased by the predetermined amount ΔS. This setting is not restrictive depending on the profile of the eccentric cam or other configuration of the steering mechanism, and the steering amount is desirably set in a manner such that a change in the belt deviation speed is substantially constant when S=S+ΔS with respect to a certain steering amount S. For example, a rate of change of the belt deviation speed is not necessarily constant even if a change in the rotation amount of the eccentric cam and a change in the tilting amount of the steering roller are caused at a constant rate. In this case, sensitivity to the steering amount of the belt deviation speed can be kept substantially constant by adjusting ΔS depending on the steering amount S. Although the rotation amount of the eccentric cam 264 is set to the same ΔS both in the steering operation (step 04) and in the steering return operation (step 11) in the present embodiment, the rotation amount may be different depending on the steering direction. For example, depending on the configuration of the steering mechanism, there may be a case where a change in the belt deviation speed when S=S+ΔS with respect to a certain steering amount S varies depending on the rotational direction of the eccentric cam, i.e., the change in the belt deviation speed has nonlinearity in the steering direction. In this case, it is only necessary to convert ΔS in the calculation unit 300*a* on the basis of the steering direction and steering amount so that sensitivity of the belt deviation speed with respect to the steering amount to be made closer to substantially constant while considering the nonlinearity in advance.

7. Steering Amount and Steering Interval

Next, the steering amount and the steering interval are described in more detail. Since the desirable settings about the steering amount and the steering interval described below are applicable to both the steering operation and the steering return operation, these operations will be collectively referred to as the steering operation here.

When performing the steering operation intermittently, the steering amount ΔS in a single steering operation and the steering interval ΔT are desirably set in consideration of the influence on the output image. Generally, the intermediate transfer belt 106 is transitionally pulled to the conveyance direction by the tilting operation of the steering roller 201. The relationship between the tilting amount of the steering roller 201 and the moving amount of the intermediate transfer belt 106 to the conveyance direction varies depending on the tension form of the intermediate transfer belt 106. However, a transitional speed change of the intermediate transfer belt 106 especially on the image transfer surface causes misalignment of the transfer positions in the conveyance direction of the intermediate transfer belt 106 when the toner images of a plurality of colors overlap one another on the intermediate transfer belt 106. This may cause color misalignment and may lower quality of an output image.

Figures 16A, 16B:
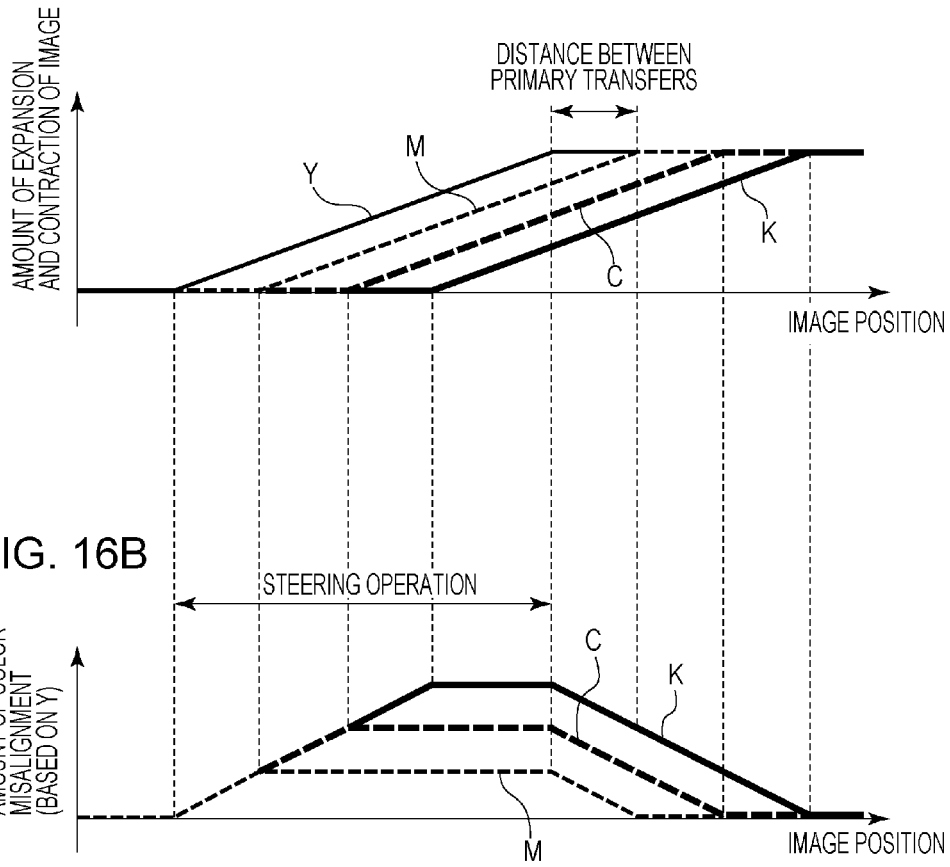
FIGS. 16A and 16B are explanatory views each illustrating a relationship between a change in a primary transfer position accompanying continuous steering operations and color misalignment.

FIG. 16A is a graph chart schematically representing a relationship between an image position and an amount of expansion and contraction of an image of each color when the steering operation is performed while the toner images of yellow, magenta, cyan and black are primarily transferred sequentially to the intermediate transfer belt 106. FIG. 16B is a graph chart corresponding to FIG. 16A schematically representing a relationship between an image position and an amount of color misalignment of the toner images of other colors to the toner image of yellow. FIGS. 16A and 16B illustrate a state that the toner images that should be primarily transferred at equal pitches are extended due to acceleration of the intermediate transfer belt 106 accompanying the steering operation, and the transfer position of the toner image of each color has been shifted from the transfer positions of the toner images of other colors. Timing of the primary transfer varies depending on the position of the primary transfer portion N1 of each color in the conveyance direction of the intermediate transfer belt 106. Therefore, the amount of color misalignment on the basis of yellow as the first color becomes larger in the color transferred in the primary transfer portion N1 which is most distant from the primary transfer portion N1Y of yellow in the conveyance direction of the intermediate transfer belt 106.

Here, the length of the image in which color misalignment is caused by the steering operation is the sum of the conveyance distance of the intermediate transfer belt 106 during the steering operation and the distance from the primary transfer portion N1 of the first color to the primary transfer portion N1 of the last color. Therefore, in a case where the length of the recording material P in the conveyance direction is short and color misalignment does not converge in a single image, or a case where the steering operation is performed during primary transfer of the latter half of a single image, an image with color misalignment is output on a subsequent recording material P. If the primary transfer portions N1 have widths in the conveyance direction of the intermediate transfer belt 106, the distance between the primary transfer portions N1 can be represented by the distance between the centers of the primary transfer portions N1 in the conveyance direction of the intermediate transfer belt 106.

In the steering operation in the direction opposite to that illustrated in FIGS. 16A and 16B, since the intermediate transfer belt 106 decelerates transitionally and the image is contracted, the relationship between yellow and other colors is reversed.

In the steering mechanism 400 of the present embodiment, the tilting center is provided at an end portion of the steering roller 201 in the direction of the rotational axis and the other end portion is moved, whereby the steering roller 201 is tilted. Therefore, in the present embodiment, a change in the conveyance speed of the intermediate transfer belt 106 and color misalignment described above become larger as the distance to the end portion which moves greatly by the steering operation in the direction of the rotational axis of the steering roller 201 becomes shorter. In a case where the tilting center is provided at the longitudinal center of the steering roller and the steering roller is tilted by moving both end portions of the direction of the rotational axis in the mutually opposite directions, the direction of color misalignment becomes opposite to each other at both ends in the width direction of the intermediate transfer belt.

To reduce color misalignment caused by a speed change of the intermediate transfer belt 106 accompanying the steering operation, it is effective to perform the steering operation as gently as possible to lower sensitivity of the speed change of the intermediate transfer belt 106 to the steering operation. However, as an operation of a mechanism system which causes the steering roller 201 to be tilted becomes more quasi-static, an influence of friction becomes larger, and the tilting operation may become unstable due to backlash and stick slip of mechanical components. That is, there is a limit in making the tilting operation itself of the steering roller 106 gentle (i.e., making the tilting speed itself lower).

Figures 17A, 17B:
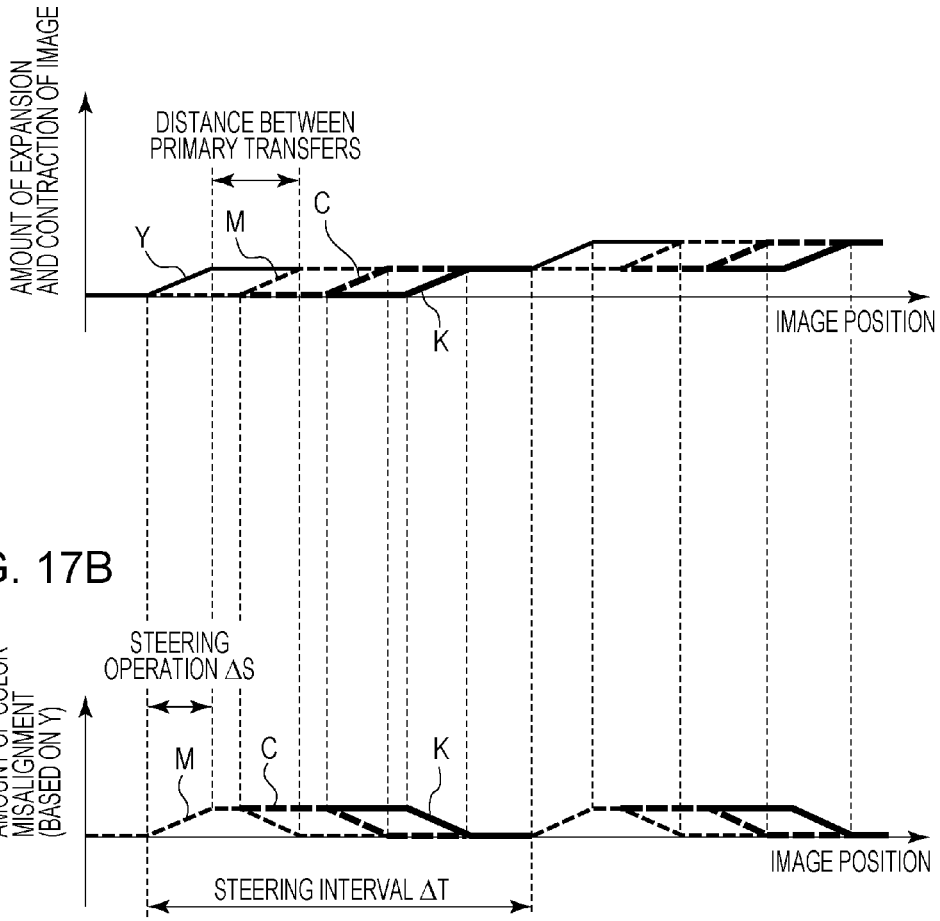
FIGS. 17A and 17B are explanatory views each illustrating a relationship between a change in a primary transfer position accompanying intermittent steering operations and color misalignment.

Then, it is effective that the tilting operation is performed intermittently as in the present embodiment while performing the tilting operation itself of the steering roller 201 in a range in which the tilting operation does not become unstable as described above. FIGS. 17A and 17B are the same diagrams as FIGS. 16A and 16B about the steering control according to the present embodiment. As illustrated in FIGS. 17A and 17B, the steering amount with which the amount of color misalignment is allowable from the viewpoint of image quality is set to ΔS, and the steering interval ΔT is desirably set to be longer than the time in which the intermediate transfer belt 106 is conveyed from the primary transfer portion N1 of the first color to the primary transfer portion N1 of the last color. Therefore, the steering operation can be performed stably, while reducing the amount of color misalignment. As illustrated in FIGS. 17A and 17B, it is desirable to set the steering operating time so that the distance in which the intermediate transfer belt 106 is conveyed during the steering operation is shorter than distance between adjoining primary transfer portions N1. Therefore, the conveyance speed of the intermediate transfer belt 106 is stabilized since a toner image of a certain color is primarily transferred until a toner image of the subsequent color is primarily transferred, thereby avoiding an increase in the amount of color misalignment in accordance with the distance to the primary transfer portion of the subsequent color. The distance between each of the primary transfer portions N1 is substantially the same in the present embodiment. If the distances between the primary transfer portions N1 are different from one another, it is desirable to set the distance in which the intermediate transfer belt 106 is conveyed during the steering operation become shorter than the shortest distance between the primary transfer portions N1.

Although the steering operation in the steering amount ΔS is performed at intervals of ΔT in the present embodiment, the steering operation may be performed in several times. The same effect is obtained also in this case, but execution of the steering operation in an excessively large number of times is not desirable since the tilting operation may become unstable due to backlash and stick slip of mechanical components as the steering amount per operation is made smaller.

In accordance with the type or the like of the recording material P, the rotational speed (the process speed) of the intermediate transfer belt 106 may be changed. In this case, the above-described time since the intermediate transfer belt 106 is conveyed from the primary transfer portion N1 of the first color to the primary transfer portion N1 of the last color changes. Therefore, depending on the rotational speed of the intermediate transfer belt 106, the steering interval ΔT can be made variable. In this case, the control unit 300 may set the steering interval ΔT in the case where the rotational speed of the intermediate transfer belt 106 is a second rotational speed which is lower than a first rotational speed to be longer than the steering interval ΔT in the case where the rotational speed of the intermediate transfer belt 106 is the first rotational speed.

Japanese Patent Laid-Open No. 2000-305415 discloses a configuration in which a tilting speed of a steering roller is set in accordance with a rotational speed of a belt. In this configuration, however, as the frequency approaches the natural frequencies of the mechanism and the drive system to make the steering roller be tilted, vibration accompanying the steering operation may be caused. Although a stepping motor of which rotation angle and rotational speed are controllable by a command pulse or a driving frequency is especially desirable as a driving source of the steering operation, there is a concern about the natural frequency of a rotor or resonance in a pulse frequency area. The maximum speed of the rotational speed of the belt in the image forming apparatus is usually about 2 or 3 times of the minimum speed and it is difficult to avoid resonance in a large driving frequency range. As described above, as an operation of a mechanism system which causes the steering roller to be tilted becomes more quasi-static, an influence of friction becomes larger, and the tilting operation may become unstable due to backlash and stick slip of electromechanical components. Therefore, as in the present embodiment, it is effective to adjust the steering interval ΔT as described above, while performing the tilting operation of the steering roller 201 intermittently.

Depending on the image formation mode (the monochrome mode or the color mode) described above, the speed at which the tendency of the belt deviation in a state where the steering operation is not performed, and the speed at which the belt deviation which occurs with respect to any steering amount is corrected may differ. This is because the tension form of the intermediate transfer belt 106 changes by the switching of the image formation modes. Therefore, if the image formation mode is switched when the intermittent steering operation is performed to correct the unidirectional belt deviation, for example, the tendency of the belt deviation may change and the belt position may be shifted toward the center. Also in this case, it can be determined that the belt position begins to return to the center as shown in the control flow described above (FIG. 13), and the steering operation can be suspended. If the speed at which the belt deviation is corrected with respect to the steering amount varies depending on the image formation modes, it is also possible to independently set the steering amount ΔS to operate in a single steering operation, and switch the steering amount ΔS for each image formation mode.

In the monochrome mode, no color misalignment occurs since only the black toner image is transferred to the intermediate transfer belt 106. Therefore, the steering amount ΔS in the monochrome mode can be made greater than the steering amount ΔS in the color mode. However, also in the monochrome mode, if the speed of the intermediate transfer belt 106 in the conveyance direction changes by the steering operation and the transfer position is shifted, partial magnification is affected. Therefore, also in the monochrome mode, it is desirable to set an upper limit in the steering amount ΔS operated while forming a single image so that both stability in steering control and quality of an output image are achieved.

As described above, the belt conveying device 200 of the present embodiment includes the control unit 300 that controls the driving unit 260 which makes the steering roller 201 be tilted on the basis of the detection result of the belt position detection mechanism 290. In the present embodiment, if the belt position detection mechanism 290 detects belt deviation in which the intermediate transfer belt 106 moves away from a predetermined position, the control unit 300 controls the driving unit 260 to make the steering roller 201 be tilted intermittently in the direction to correct the belt deviation. If it is detected by the belt position detection mechanism 290 that the moving direction of the intermediate transfer belt 106 has changed to the direction to approach the predetermined position during the stop period between the intermittent tilt operations, the control unit 300 suspends without performing the subsequent tilt operation of the steering roller 201. The control unit 300 desirably controls the time required for a single tilting operation to make the tilting steering roller 201 be tilted intermittently to be shorter than the time in which the intermediate transfer belt 106 is conveyed for the distance between transfer portions adjoining in the conveyance direction of the intermediate transfer belt 106. The control unit 300 desirably controls the time since a certain tilting operation is started until the subsequent tilting operation is started when the tilting steering roller 201 is intermittently tilted to be longer than the time in which the intermediate transfer belt 106 is conveyed over the distance from the transfer portion at which the transfer is performed first to the transfer portion at which the transfer is performed last in the conveyance direction of the intermediate transfer belt 106 among a plurality of transfer portions. The image forming apparatus 100 may include a conveyance speed switching unit which switches among a plurality of speed modes with different conveyance speeds of the intermediate transfer belt 106. In the present embodiment, the control unit 300 functions also as the conveyance speed switching unit. The image forming apparatus 100 may include an image formation mode switching unit which switches among a plurality of image formation modes with different number of photoconductive drums 101 with which the intermediate transfer belt 106 is in contact to form the transfer portions among a plurality of photoconductive drums 101. In the present embodiment, the control unit 300 functions also as the image formation mode switching unit. In this case, the control unit 300 can change the tilting amount per operation in accordance with the image formation mode when the steering roller 201 is tilted intermittently. The control unit 300 can typically set the tilting amount per operation when the steering roller 201 is tilted intermittently to be larger in an image formation mode in which a single transfer portion is formed than in an image formation mode in which a plurality of transfer portions are formed. Although the single transfer portion is the transfer portion N1K for black in the present embodiment, the transfer portion may be for any other one of colors.

As described above, according to the present embodiment, when deviation of the belt position occurs, the tilting operation of the steering roller 201 is performed intermittently and the tilting amount is increased or decreased stepwise, whereby a transitional speed change of the intermediate transfer belt 106 can be reduced. Further, since the tilting amount is added while checking the reaction to the behavior of the intermediate transfer belt 106, excessively high moving speed in the width direction of the intermediate transfer belt 106 can be avoided when correcting the belt deviation, and deviation of the belt position can be corrected gently. Since the intermediate transfer belt is conveyed at a plurality of conveyance speeds by changing the interval of the steering operation, resonance of the drive systems or unstable operations of the steering tilt mechanism can be avoided. The following effects are obtained especially in an image forming apparatus 100 in which the toner images of a plurality of colors are transferred to the intermediate transfer belt 106 sequentially to overlap one another. The influence on the image quality accompanying the steering operation can be reduced by changing the interval of the steering operation so that the steering amount from the primary transfer of the first color to the primary transfer of the last color becomes the same at a plurality of conveyance speeds of the intermediate transfer belt 106.

Other Embodiments

Although aspects of the present invention have been described with reference to the above embodiment, aspects of the present invention are not limited to the same.

Although the number of the image forming units is four in the above embodiment, the number of the image forming units is not limited to four and may be less or more. The order of arrangement of the image forming units for color images is not limited to that in the above embodiment.

Although the intermediate transfer belt is trained around five tension rollers in the above embodiment, the number of the tension rollers around which the intermediate transfer belt is trained is not limited to five and may be less or more.

Figure 18:
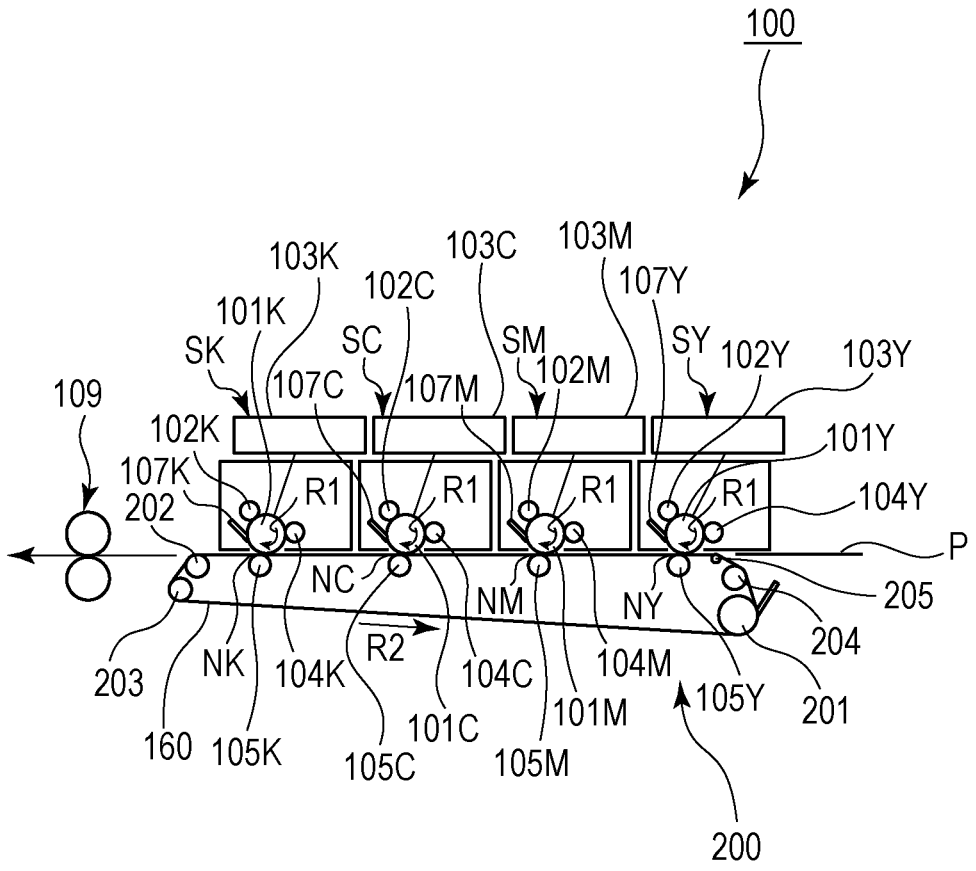
FIG. 18 is a schematic cross-sectional view illustrating a main part of an image forming apparatus of another embodiment.

Although the image forming apparatus of the intermediate transfer system is described in the above embodiment, aspects of the present invention are applicable also to an image forming apparatus of a direct transfer system. FIG. 18 is a schematic cross-sectional view of a main part of the image forming apparatus of the direct transfer system. In FIG. 18, components having the same or corresponding functions or configurations as those of the image forming apparatus illustrated in FIG. 1 are denoted by the same reference numerals. An image forming apparatus 100 illustrated in FIG. 18 includes a recording material support belt 160 constituted by an endless belt as a recording material bearing member instead of the intermediate transfer belt 106 in the image forming apparatus 100 of FIG. 1. In the image forming apparatus 100 illustrated in FIG. 18, a toner image formed on a photoconductive drum 101 by each image forming unit S is transferred, in each transfer portion N, to a recording material P born and conveyed on the recording material support belt 160. Also in the image forming apparatus 100 of the direct transfer system, a steering mechanism may be provided to correct misalignment of a position of the recording material support belt 160 in the width direction caused by belt deviation. Therefore, aspects of the present invention are applicable also to the image forming apparatus of the direct transfer system, and provides the same effects as those of the above embodiment. Further, aspects of the present invention are applicable also to a belt conveying device employing a photoconductor belt and an electrostatic recording dielectric belt as a belt, an image forming apparatus provided with such a belt conveying device, and the like.

According to aspects of the present invention, the transitional change in the conveyance condition of the belt caused by the tilt of the steering roller and the excessively high moving speed of the belt in the width direction can be reduced.

While aspects of the present invention have been described with reference to exemplary embodiments, it is to be understood that aspects of the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-171568, filed Aug. 31, 2015, which is hereby incorporated by reference herein in its entirety.

What is claimed is:

1. A belt conveying device comprising:

an endless belt;

a first roller around which the belt is supported and configured to convey the belt;

a second roller around which the belt is supported, at least one end side of the second roller being supported to be swingable, and capable of changing a position of the belt in a width direction;

a first detection portion configured to detect that the position of the belt in the width direction is in a first area located on the outer side than a predetermined position in the width direction of the belt;

a second detection portion configured to detect that the position of the belt in the width direction is in a second area adjacent to the first area and located on the outer side than the first area in the width direction of the belt;

a motor configured to steer the second roller; and a control unit configured to control the motor based on a detection result of the first detection portion and the second detection portion, wherein, when it is detected that an end portion of the belt has moved to the second area from the first area, the control unit increases a steering amount of the second roller intermittently to a predetermined upper limit while the end portion of the belt is located in the second area and, when the end portion of the belt returns to the first area from the second area before the steering amount of the second roller reaches the predetermined upper limit, the control unit stops increasing in the steering amount of the second roller to the predetermined upper limit.

2. The belt conveying device according to claim 1, wherein the control unit controls the motor to keep the steering amount of the second roller at the time of returning to the first area until the belt returns to a predetermined reference position after returning to the first area.

3. The belt conveying device according to claim 2, wherein the control unit controls the motor to decrease the steering amount of the second roller intermittently after the belt returns to the predetermined reference position.

4. An image forming apparatus, comprising:

an endless belt to which a toner image is transferred; and an image forming unit configured to form an image, wherein the image forming unit includes a plurality of image bearing members arranged along a conveyance direction of the belt, and images born by the plurality of image bearing members are transferred to the belt;

a first roller around which the belt is supported and configured to convey the belt;

a second roller around which the belt is supported, at least one end side of the second roller being supported to be swingable, and capable of changing a position of the belt in a width direction;

a first detection portion configured to detect that the position of the belt in the width direction is in a first area located on the outer side than a predetermined position in the width direction of the belt;

a second detection portion configured to detect that the position of the belt in the width direction is in a second area adjacent to the first area and located on the outer side than the first area in the width direction of the belt;

a motor configured to steer the second roller; and a control unit configured to control the motor based on a detection result of the first detection portion and the second detection portion, wherein, when it is detected that an end portion of the belt has moved to the second area from the first area, the control unit increases a steering amount of the second roller intermittently to a predetermined upper limit while the end portion of the belt is located in the second area and, when the end portion of the belt returns to the first area from the second area before the steering amount of the second roller reaches the predetermined upper limit, the control unit stops increasing the steering amount of the second roller to the predetermined upper limit.

5. The image forming apparatus according to claim 4, wherein a first mode in which an image is formed with the driving speed of the belt being a first speed, and a second mode in which an image is formed with the driving speed of the belt being a second speed which is lower than the first speed, are executable and, if the steering amount of the second roller is changed intermittently while the first mode is being executed, the control unit controls a steering interval between a previous steering of the second roller and a subsequent steering is controlled to a first interval and, if the steering amount of the second roller is changed intermittently while the second mode is being executed, the control unit controls the steering interval to a second interval which is longer than the first interval.

6. The image forming apparatus according to claim 4, wherein toner images are transferred to the belt from the plurality of image bearing members in a plurality of transfer positions in which the belt is in contact with the plurality of image bearing members, and the plurality of transfer positions including a first transfer position and a second transfer position adjacent to the first transfer position in the conveyance direction of the belt, the control unit controls time required for a single steering operation to steer the second roller intermittently to be shorter than time in which the belt is conveyed over a distance between the first transfer position and the second transfer position.

7. The image forming apparatus according to claim 4, wherein the control unit controls time from start of a steering operation to start of a subsequent steering operation when steering the second roller intermittently to be longer than time in which the belt is conveyed over a distance from the transfer position at which the transfer is performed first to the transfer position at which the transfer is performed last in the conveyance direction of the belt among a plurality of transfer positions.

8. The image forming apparatus according to claim 4, further comprising an image formation mode switching unit configured to switch among a plurality of image formation modes with different number of image bearing members which are in contact with the belt among the plurality of image bearing members, wherein the control unit changes the steering amount per operation to steer the second roller intermittently in accordance with the image formation mode.

9. The image forming apparatus according to claim 8, wherein the control unit sets the steering amount per operation to steer the second roller intermittently to be greater in an image formation mode in which one image bearing member is in contact with the belt for image formation than in an image formation mode in which the plurality of image bearing members are in contact with the belt for image formation.

10. A belt conveying device comprising:

an endless belt;

a first roller around which the belt is supported and configured to convey the belt;

a second roller around which the belt is supported, at least one end side of the second roller being supported to be swingable, and capable of changing a position of the belt in a width direction;

a first detection portion configured to detect that the position of the belt in the width direction is in a first area located on the outer side than a predetermined position in the width direction of the belt;

a second detection portion configured to detect that the position of the belt in the width direction is in a second area adjacent to the first area and located on the outer side than the first area in the width direction of the belt;

a motor configured to steer the second roller; and a control unit configured to control the motor based on a detection result of the first detection portion and the second detection portion, wherein, when it is detected that an end portion of the belt has moved to the second area from the first area, the control unit increases a steering amount of the second roller and, when the end portion of the belt returns to the first area from the second area, the control unit stops increasing the steering amount of the second roller.

11. The belt conveying device according to claim 10, wherein when it is detected that an end portion of the belt has moved to the second area from the first area, the control unit increases the steering amount of the second roller to a predetermined upper limit while the end portion of the belt is located in the second area and, when the end portion of the belt returns to the first area from the second area before the steering amount of the second roller reaches the predetermined upper limit, the control unit stops increasing the steering amount of the second roller to the predetermined upper limit.

12. The belt conveying device according to claim 10, wherein the control unit controls the motor to keep the steering amount of the second roller at the time of returning to the first area until the belt returns to a predetermined reference position after returning to the first area.

13. The belt conveying device according to claim 11, further comprising:

an image forming unit configured to form an image, wherein the image forming unit includes a plurality of image bearing members arranged along a conveyance direction of the belt, and images born by the plurality of image bearing members are transferred to the belt at a plurality of transfer positions respectively;

wherein the control unit controls time from start of a steering operation to start of a subsequent steering operation when steering the second roller intermittently to be longer than time in which the belt is conveyed over a distance from the transfer position at which the transfer is performed first to the transfer position at which the transfer is performed last in the conveyance direction of the belt among the plurality of transfer positions.

* * * * *